US005272427A

United States Patent [19]

Nold et al.

[11] Patent Number: 5,272,427

[45] Date of Patent: Dec. 21, 1993

[54] FURNACE CONTROL APPARATUS AND METHOD

[75] Inventor: Craig M. Nold, Lexington, Ky.; Mark E. Miller, Versailles, Ky.; Mitchell R. Rowlette, Berea, Ky.; Robert B. Brown, Lexington, Ky.

[73] Assignee: Texas Instruments Incorporated, Dallas, Tex.

[21] Appl. No.: 886,275

[22] Filed: May 20, 1992

[51] Int. Cl.[5] ..... G05B 13/02; F24H 3/00; G05D 29/00

[52] U.S. Cl. ..... 318/672; 318/62; 318/102; 318/459; 318/471; 318/567; 388/907; 388/934

[58] Field of Search ..... 318/567, 34, 268, 471, 318/472, 51, 53, 59, 62, 66, 67, 101, 102, 103, 443, 445, 484, 668, 671, 672, 634, 641; 388/934, 907.5; 307/38, 39, 40, 41, 115

[56] References Cited

U.S. PATENT DOCUMENTS 4,303,383 12/1981 Black et al. ..... 307/115 X
4,341,345 7/1982 Hammer et al. ..... 307/39 X
4,345,162 8/1982 Hammer et al. ..... 307/39
4,352,349 10/1982 Yoho .
4,648,551 3/1987 Thompson et al. .
4,659,290 4/1987 Kundert .
4,688,547 8/1987 Ballard et al. .
4,722,669 2/1988 Kundert .
4,789,330 12/1988 Ballard et al. .
4,860,231 8/1989 Ballard et al. .
4,863,372 9/1989 Berlincourt .
4,901,918 2/1990 Geary et al. .
4,934,925 6/1990 Berlincourt .
4,935,606 6/1990 Geary .
4,935,607 6/1990 Kadwell et al. .
4,978,896 12/1990 Shah .
5,076,780 12/1991 Erdman ..... 431/24

*Primary Examiner*—Bentsu Ro
*Attorney, Agent, or Firm*—Russell E. Baumann; Richard L. Donaldson; Rene' E. Grossman

[57] ABSTRACT

An electric control for gas furnaces which controls a two speed main blower fan and an induction draft fan based on inputs from a room thermostat, a high limit and an ignition control including a gas valve. The control has a circuit board having a power supply for providing 24 volts DC current source to drive DC relays and a 5 volt DC power source to power a microprocessor. 24 volt AC input signals are coupled to the input ports of the microprocessor through current limiting resistors and to AC ground through pull down resistors. AC ground is also connected to the IRQ port of the microprocessor. The output ports of the microprocessor are connected to a relay driver which in turn is connected to the relays. Several breakaway tabs in the board provide optional features such as eliminating a normally provided draft delay timing function. Test pads are provided on the board so that the board can be tested during manufacture. An optional feature is shown comprising an LED which can be used to indicate the status of the system. Another optional feature incorporates a zener diode and resistor coupled to each input port to increase input thresholds. This feature is provided for use with power stealing electronic thermostats.

The control calibrates itself on a continuing periodic basis to read the AC inputs synchronously at the peak of their wave and switches the relays asynchronously based on the real time clock of the microprocessor.

22 Claims, 18 Drawing Sheets

INPUT CALIBRATION ROUTINE

PROGRAM OVERVIEW

COUNTER ROUTINE

INDUCED DRAFT OUTPUT ROUTINE

MEMORY MAP

COUNTERS

GOFFCTR
IDOFFCTR
MVOFFCTR
MVOFFCTR

FLAGS

GFLAG1, GFLAG2
WFLAG1, WFLAG2
MVONFLAG
MVOFFLAG1, MVOFFLAG2

248

| | 7 | 6 | 5 | 4 | 3 | 2 | 1 | 0 |
|---|---|---|---|---|---|---|---|---|
| FLAGREG1 | RFLAG | GFLAG1 | GFLAG2 | WFLAG1 | WFLAG2 | MVOFFLAG1 | MVOFFLAG2 | MVONFLAG |

250

| | PB 7 | 6 | 5 | 4 | 3 | 2 | 1 | 0 |
|---|---|---|---|---|---|---|---|---|
| INPUTS | | | G/EON | R/LIMIT | W1 | MV | | W2 |

252

| | 7 | 6 | 5 | 4 | 3 | 2 | 1 | 0 |
|---|---|---|---|---|---|---|---|---|
| FLAGREG2 | COOL | HEAT | IND DFT | | CL_HTFLAG | HT_CLFLAG | TIMEOUT2 | TIMEOUT1 |
| | PA2 | PA1 | PA0 | | | | | |

254

| | 2 | 1 | 0 |
|---|---|---|---|
| OUTPUTS | COOL | HEAT | IND DFT |

Fig. 14.

HEAT TRUTH TABLE

| INPUTS | | | | OUTPUT |
|---|---|---|---|---|
| RFLAG | MVONFLAG | MVOFFLAG1 | MVOFFLAG2 | HEAT |
| 0 | 0 | 0 | 0 | 1 |
| 0 | 0 | 0 | 1 | 1 |
| 0 | 0 | 1 | 0 | 1 |
| 0 | 0 | 1 | 1 | 1 |
| 0 | 1 | 0 | 0 | 1 |
| 0 | 1 | 0 | 1 | 1 |
| 0 | 1 | 1 | 0 | 1 |
| 0 | 1 | 1 | 1 | 1 |
| 1 | 0 | 0 | 0 | 0 |
| 1 | 0 | 0 | 1 | 1 |
| 1 | 0 | 1 | 0 | 1 |
| 1 | 0 | 1 | 1 | 1 |
| 1 | 1 | 0 | 0 | 0 |
| 1 | 1 | 0 | 1 | 1 |
| 1 | 1 | 1 | 0 | 1 |
| 1 | 1 | 1 | 1 | 1 |

Fig. 15.

COOL TRUTH TABLE

| INPUTS | | OUTPUT |
|---|---|---|
| G/ECON | GDLYOFF | COOL |
| 0 | 0 | 0 |
| 0 | 1 | 1 |
| 1 | 0 | 1 |
| 1 | 1 | 1 |

Fig. 16.

INDUCED DRAFT TRUTH TABLE

| INPUTS | | | | OUTPUT |
|---|---|---|---|---|
| RFLAG | MVONFLAG | WFLAG1 | WFLAG2 | IND DFT ON |
| 0 | 0 | 0 | 0 | 1 |
| 0 | 0 | 0 | 1 | 1 |
| 0 | 0 | 1 | 0 | 1 |
| 0 | 0 | 1 | 1 | 1 |
| 0 | 1 | 0 | 0 | 1 |
| 0 | 1 | 0 | 1 | 1 |
| 0 | 1 | 1 | 0 | 1 |
| 0 | 1 | 1 | 1 | 1 |
| 1 | 0 | 0 | 0 | 0 |
| 1 | 0 | 0 | 1 | 1 |
| 1 | 0 | 1 | 0 | 1 |
| 1 | 0 | 1 | 1 | 1 |
| 1 | 1 | 0 | 0 | 1 |
| 1 | 1 | 0 | 1 | 1 |
| 1 | 1 | 1 | 0 | 1 |
| 1 | 1 | 1 | 1 | 1 |

Fig. 17.

FURNACE CONTROL APPARATUS AND METHOD

BACKGROUND OF THE INVENTION

This invention relates generally to furnace controls and more specifically to microprocessor based gas furnace controls.

Typically, the control of gas furnaces includes the control of main and induced draft fan motors having selected time delays in conjunction with an ignition control, gas valve and thermostat.

Control of these functions by a microprocessor is known; however, such controls have suffered from the limitation that their timing mechanisms have been more erratic than desirable. Utilizing IC networks such as internal oscillator for timing results in an unsatisfactory tolerance with timing varying plus or minus fifty percent or more. Not only does the timing vary within a particular microprocessor but also from one microprocessor to another. There is a need to provide a control which has significantly improved reliability, particularly in relations to providing consistent timing functions over a wide temperature range, e.g., from minus 40° C. To 85° C.

It is an object of the present invention to provide a control for gas furnace controls which has improved, consistent and reliable timing.

Another object is the provision of a microprocessor control which has timing consistency within plus or minus ten percent over a temperature range of minus 40° C. to 85° C.

Yet another object of the invention is the provision of a microprocessor furnace control which is of relatively low cost, reliable and one which results in improved relay contact life.

BRIEF SUMMARY OF THE INVENTION

Briefly, in accordance with the invention, a control circuit controls the heat speed and cool speed of a fan motor based on inputs from a room thermostat, a gas valve and a high limit switch. All the control inputs are 24 VAC signals which are inputted to a microprocessor through current limiting resistors and with the IRQ input connected to the 24 VAC transformer common which, according to a feature of the invention, is used to provide a reference point for reading the input signals. The microprocessor outputs directly drive a relay driver in the form of an array of darlington transistors which operate DC relays. The control circuit has a power circuit providing 24 VAC and a full wave rectified voltage to power the relays as well as 5 VDC required of the microprocessor.

According to a feature of the invention a calibration routine is executed upon initialization and on an ongoing basis to synchronize readings of the AC inputs. The input routine executes as an IRQ interrupt routine and reads the inputs at the peak of the AC signal and must read a selected number of good readings before updating an input register. A one second flag is also derived from this 60 hertz input routine.

According to another feature of the invention the output is executed based on the Real Time Interrupt Clock which operates from the internal oscillator which is asynchronous to the 60 hertz line frequency. The output port is updated with the contents of the output register on every interrupt.

According to another feature of the invention the main control program causes the inputs to be read and flags set for the present and previous states and based on the status of the flag registers the output register is updated. Timing functions are performed using the one second clock and counting registers. The program verifies that the interrupt routines are working before executing the main program. If an interrupt does not occur within the watchdog period the microprocessor is reset. When the outputs are idle the microprocessor generates an internal reset every 256 seconds.

According to a feature of the invention when the IRQ line is at DC a test sequence occurs on the inputs with the part number, revision number and status outputted. The microprocessor can be put into an accelerated timing mode for further testing.

In a modified embodiment particularly adapted for use with electronic thermostats a selected pull down resistor is connected to the input signal lines along with a zener diode. This results in increased switching threshold voltages from the thermostat and allows compatibility with power stealing thermostats.

BRIEF DESCRIPTION OF THE DRAWINGS

FIG. 14 is a memory map;

FIGS. 15–17 are truth tables for heat and cool speeds and induced draft fans respectively.

DETAILED DESCRIPTION OF THE DRAWINGS

Figure 1:
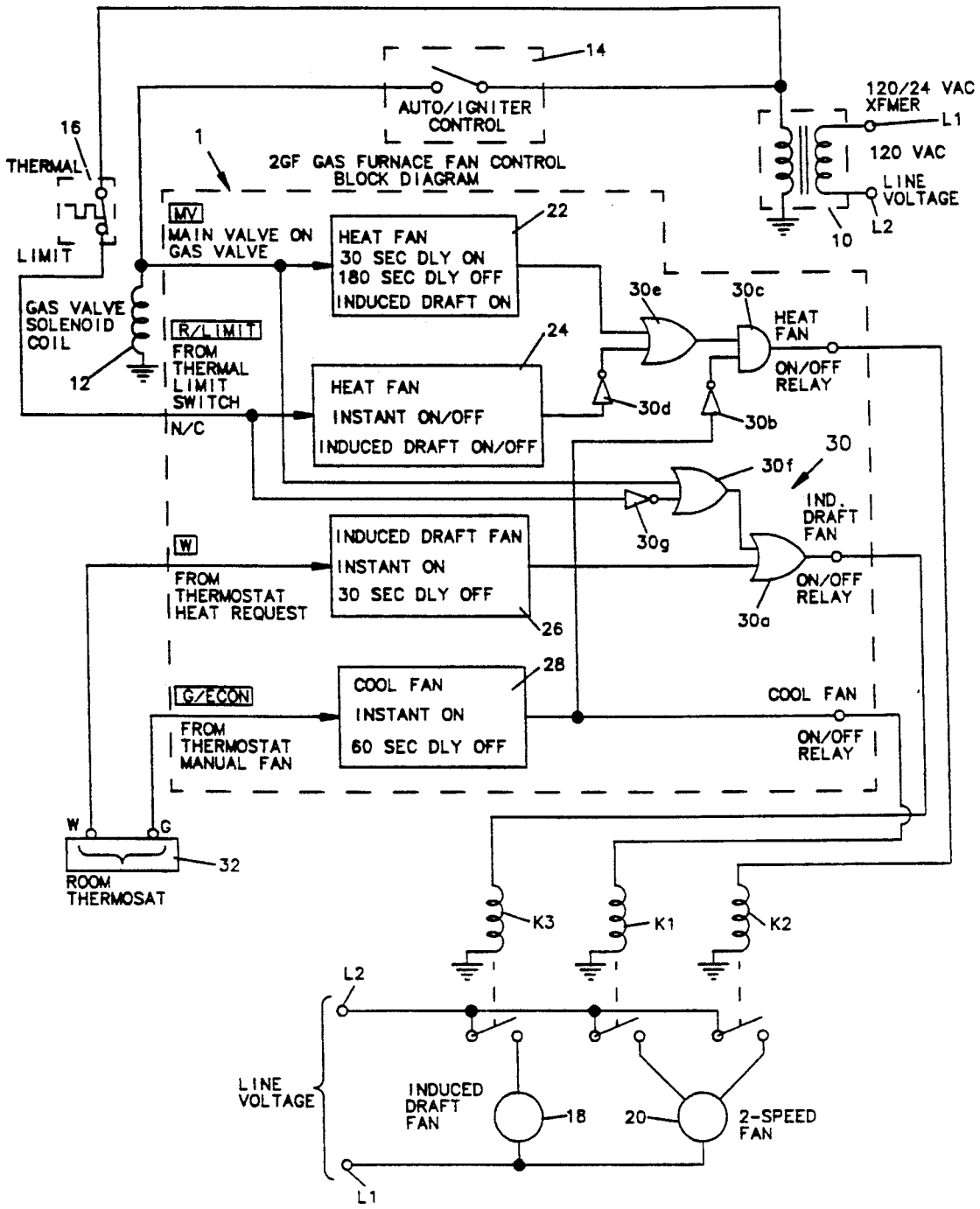
FIG. 1 is a schematic of a system in which a circuit board made in accordance with the invention is used with the board shown by functions performed by the control.

With particular reference to FIG. 1 the several components of the system are shown along with a schematic representation of the functions provided by the control made in accordance with the invention.

A 120/24 VAC transformer 10 provides 24 volt AC power to a gas valve solenoid coil 12 and MV terminal on control board 1 through autoigniter control 14. The 24 volt AC power is also connected through a thermal limit 16 to R/Limit terminal on control board 1. Terminals W and G of a room thermostat 32 are connected respectively to terminals W and G/ECON on board 1.

An induced draft fan motor 18 and a two speed fan motor 20 are shown connected across line voltage L1, L2. Energization of fan motor 18 is controlled by a relay coil K3 from an output on board 1 and energization of cool speed and heat speed of fan motor 20 are controlled respectively from outputs on board 1 by relay coils K1 and K2.

Control board 1 is shown with functional blocks 22, 24, 26 and 28. Block 22, which receives an input from terminal MV, main valve, provides a heat fan energization signal with a selected time delay of 30 seconds on and 180 seconds off and an instantaneous induced draft fan energization. Block 24, which receives an input through normally closed thermal limit switch 16, provides a heat fan energization signal, instant on and off and induced draft fan energization, instant on and off. Block 26, which receives a heat request input from terminal W of room thermostat 32, provides an induced draft fan energization signal, instant on and a thirty second delay off. Block 28, which received a manual cool fan request input from room thermostat 32, provides a cool fan motor energization signal, instant on and a sixty second delay off.

Also shown in FIG. 1 are a group of symbols 30 used to describe the logic inter-relating the various inputs to provide the desired functional outputs which are actually provided in the software routines to be discussed below.

Thus a G signal received from room thermostat 32 turns on the cool fan instantly which remains on for sixty seconds after the signal is turned off at the room thermostat. A W or a heat request signal from the room thermostat is sown going through an OR gate **30*a*** results in the induced draft fan being turned on instantly and remaining on for thirty seconds after the W signal is turned off at the thermostat.

A G input is also shown connected through an invertor **30*b* to an AND gate 30*c* whose output is connected to the heat fan coil K2 so that an on or high signal from block 28 will be converted to a low signal being input to AND gate 30*c*** indicating that a cool speed fan request will override a heat speed fan request.

Thermal limit switch 16 is normally always energized providing a high input to block 24, which is inverted to a low through invertor **30*d*, and a normal low input to OR gate 30*e*. When autoigniter control 14 is energized a high will be input to block 22 which will result in a high output from OR gate 30*e* and, assuming a low cool fan signal, will result in a high from AND gate 30*c* thereby energizing heat from relay coil K2. Energization of the gas valve 12 also provides a high input into OR gate 30*f* which in turn provides a high input to OR gate 30*a*** to energize induced draft fan relay coil K3.

If thermal limit switch 16 opens because of a fault condition it provides a low input to invertor **30*g* which results in a high input to OR gate 30*f* thereby providing a high input to OR gate 30*a* and energization of induced draft fan 18. In addition, unless there is a signal calling for cool fan energization then the opening of thermal limit 16 will cause energization of heat fan relay coil K2 by providing a low input to invertor 30*d* which is changed to high input to OR gate 30*e* and a high input to AND gate 30*c***.

Figure 2:
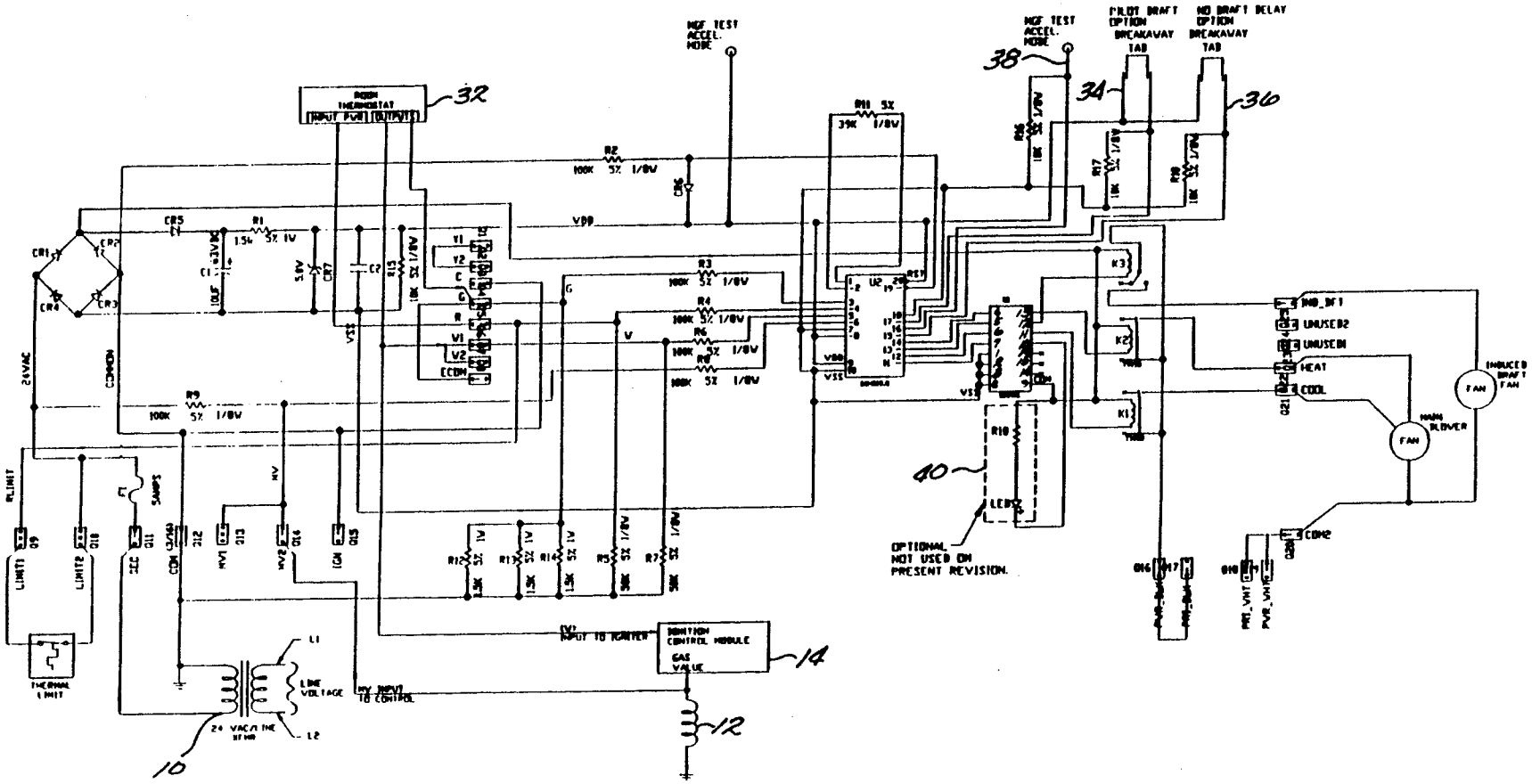
FIG. 2 is a schematic of the FIG. 1 system in which the structural components of the circuit board is shown.
Figure 2A:
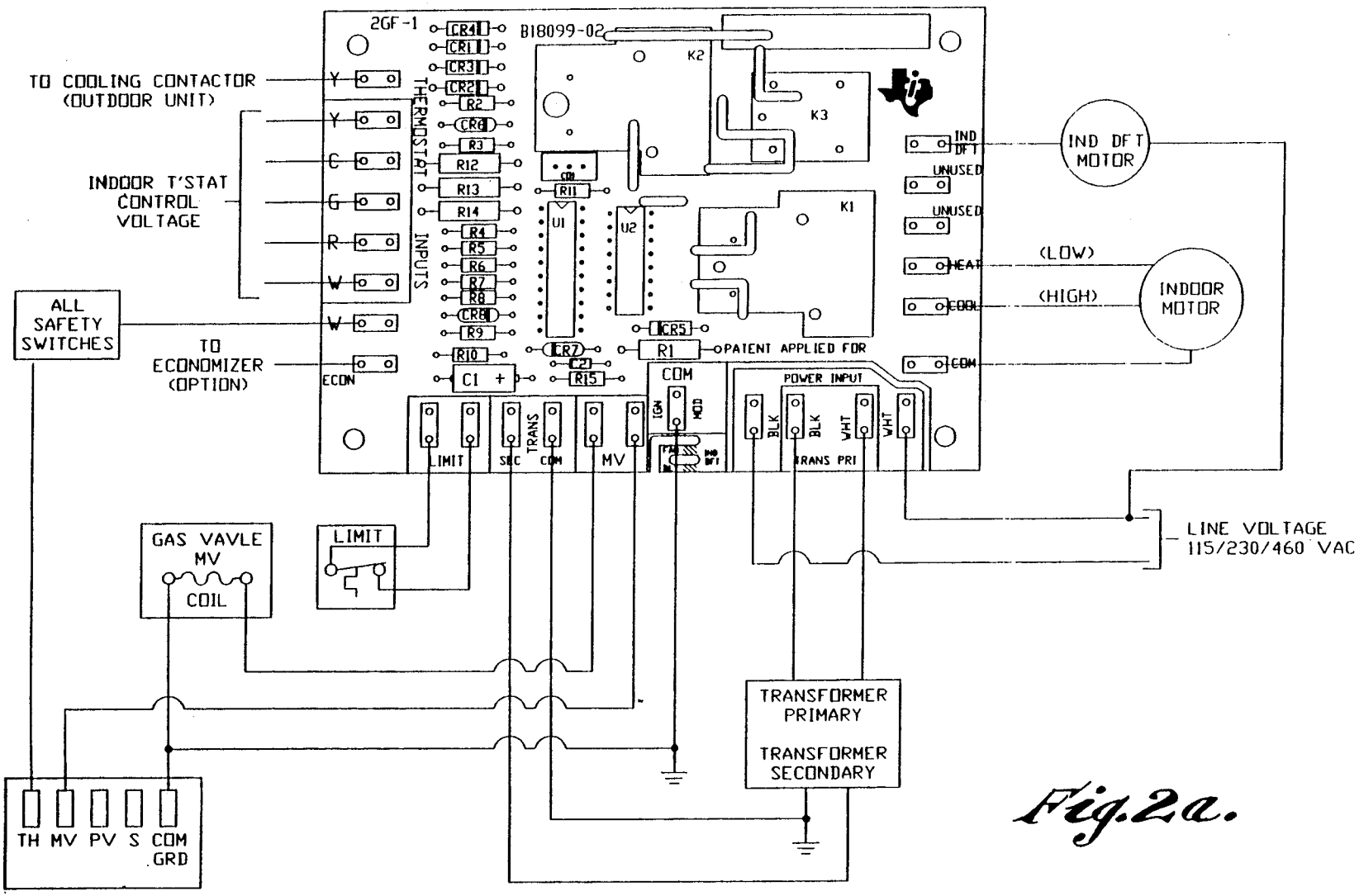
FIG. 2*a* shows the component layout on the circuit board along connections to the several system components.

Turning now to FIG. 2 a schematic representation is shown of a control circuit made in accordance with the invention along with other components of a gas furnace system with which the control circuit is used. Transformer 10, providing 24 volts AC from line voltage, is connected at the 24 VAC output side to connector Q11 and then through a 5 amp fuse F1 to a full wave bridge comprising diodes CR1, CR1, CR3 and CR4. The transformer common is connected to the bridge through connector Q12. The bridge provides full wave rectified 24 VAC power to drive relays K1, K2 and K3 to be discussed below. Zener diode CR7 suppresses back EMF. Capacitor C2, resistor R15 and capacitor C1, resistor R1 provide 5 volts DC on line VDD for the power supply of microprocessor U2 to be discussed below.

There are several low voltage AC input terminals labeled Y1, Y2, C, G, R, W1, W2 and ECON. Terminals Y1, Y2 are not used in the present embodiment. Terminal C is connected to the transformer common, terminal G is coupled to an output of room thermostat 32 and to input port 3 of microprocessor U2 through a 100K ohm resistor R3 and is connected to common through pull down resistors R12, R13, R14 of 1.5 ohms connected in parallel to provide an equivalent resistance of 500 ohms. Terminal G is also connected to the terminal ECON. A signal on the G terminal results in energizing the manual fan as well as providing a cool request as will be explained further below. Terminal W is coupled to an output of room thermostat 32 and to the ignition control module 14, the other side of which is connected to common through the gas valve solenoid coil 12 and to connector Q14. Terminal W1, interconnected with terminal W2, is connected to input port 5 of microprocessor U2 through limiting resistor R6 of 100K ohms and to common through pull down resistor R7 of 50K ohms. Connector Q14 is connected to the 24 VAC output of transformer 10 through 100K ohm pull up resistor R9 and to input port 6 of microprocessor U2 through limiting resistor R8 of 100K ohms. It should be noted that there is no separate pull down resistor required since the main valve itself serves as a pull down resistor. Pull up resistor R9 serves as a safety feature. That is, if for any reason, the gas valve is not correctly wired to the control circuit since there is no pull down resistor to common pull up resistor R9 will always provide a high input thereby turning the induced draft fan on.

Another input to microprocessor U2 is IRQ port 19 which is a common input received through 100K ohm resistor R2. Clamping diode CR6 connected between port 19 and the 5 volt supply VDD drops the input at 5 volts.

Microprocessor U2 has two additional, optional inputs provided by breakaway tabs 34, 36. Input port 15 is connected to the 5 volt supply VDD through breakaway tab 36 and to DC ground or common VSS through 10K ohm resistor R10. Normally the system provides a selected period of time that the draft fan is maintained in the energization condition after its energization signal has been removed. This occurs when port 15 is pulled high by its connection with the 5 volt supply VDD. However, if tab 36 is broken off resistor R10 will pull port 15 to ground providing a low. Then the draft fan is turned off at the same time its energization signal has been removed.

Similarly, port 17 is connected to the 5 volt supply VDD through tab 34 and to ground VSS through 10K ohm resistor R17. Tab 34 provides a pilot draft option.

Reference numeral 38 indicates a wiring point which is used for testing the control. That is, by placing a 5 volt DC input at point 38 the control is placed in a test mode in effect shortening all the normal time delays. Point 38 is connected to port 16 of microprocessor U2 and ground through 10K ohm resistor R16. DC ground VSS is also connected to ports 10 and 7 of microprocessor U2.

Output ports 11–14 are connected to relay driver integrated circuit U1 at pins 7, 6, 5 and 4 respectively. Relay driver U1 comprises a transistor network which, in effect, switch on relays K1, K2, K3 when the base of the transistors receive an input signal from microprocessor U2. Output pin 12 of relay driver U1 is connected to the coil of relay K3 which has a common contact connected to power connectors Q16, Q17 and a normally open contact connected to connector Q25.

Power connectors Q16, Q17 are connected to switching mechanisms in respective relays K1, K2, K3. Energization of the relay coil of relay K1 through output port 11 will cause the switch to connect power to terminal Q21, the cool speed of the fan motor. Energization of the relay coil of relay K2 through output port 13 will cause the switch to connect power to terminal Q22, the heat speed of the fan motor. Energization of the relay coil of relay K3 through output port 12 will cause the switch to connect power to terminal Q25 , the induced draft fan motor.

An optional feature is shown at the dashed line box identified by numeral 40 comprising resistor R18 serially connected to LED between pin 10 of relay drive U1 and common, pin 9. This feature provides a flashing or continuous LED based on the state of the inputs.

Resistor R11 of 39K ohms is connected to pins 1 and 2 of microprocessor U2 to provide a selected rate of oscillation for the internal clock.

The control board is provided with Q9 and Q10 to connect the high limit switch. The high limit switch is normally closed but adapted to open upon an over temperature condition. An economizer function is tied to terminal G. This can be used as an output in a system having an economizer, i.e., an option which, for example, opens a duct to outside fresh air when the manual fan is on.

Figure 3:
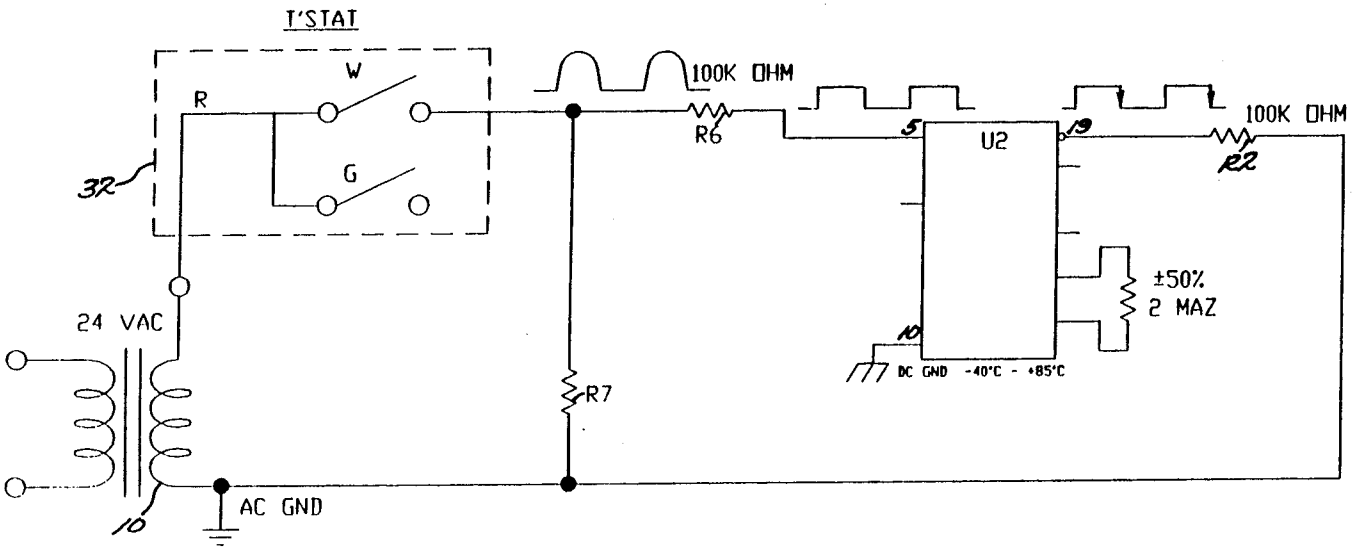
FIG. 3 is a simplified version of FIG. 2 showing one of the AC input signal lines and the microprocessor and several wave forms.
Figure 3A:
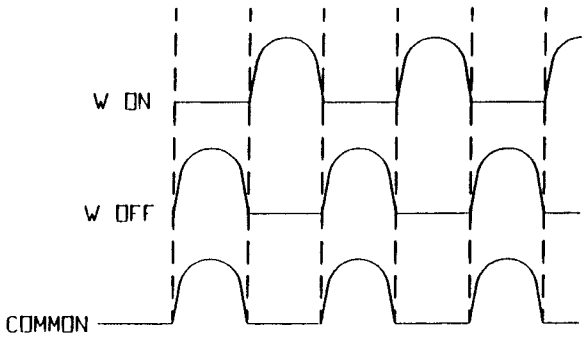
FIG. 3*a* depicts wave forms relating to FIG. 3.

With reference to FIG. 3 which is a simplified portion of FIG. 2, one of the inputs will be described. With respect to the W terminal, due to the internal structure of the CMOS microprocessor which includes intrinsic diodes on both the P and N channels of the FETs which serve to limit input voltage to 5 volts, a simple current limiting resistor R6 can be inputted to port 5 of microprocessor U2 along with a resistor R7 tied to common. When the room thermostat 32 provides a heat request signal by connecting 24 VAC from transformer 10 a wave form on the W line is shown in FIG. 3*a* as $W_{on}$. When terminal W is not energized port 5 of the microprocessor is tied to common with its wave form shown at $W_{off}$, which is the same as common.

Figure 4:
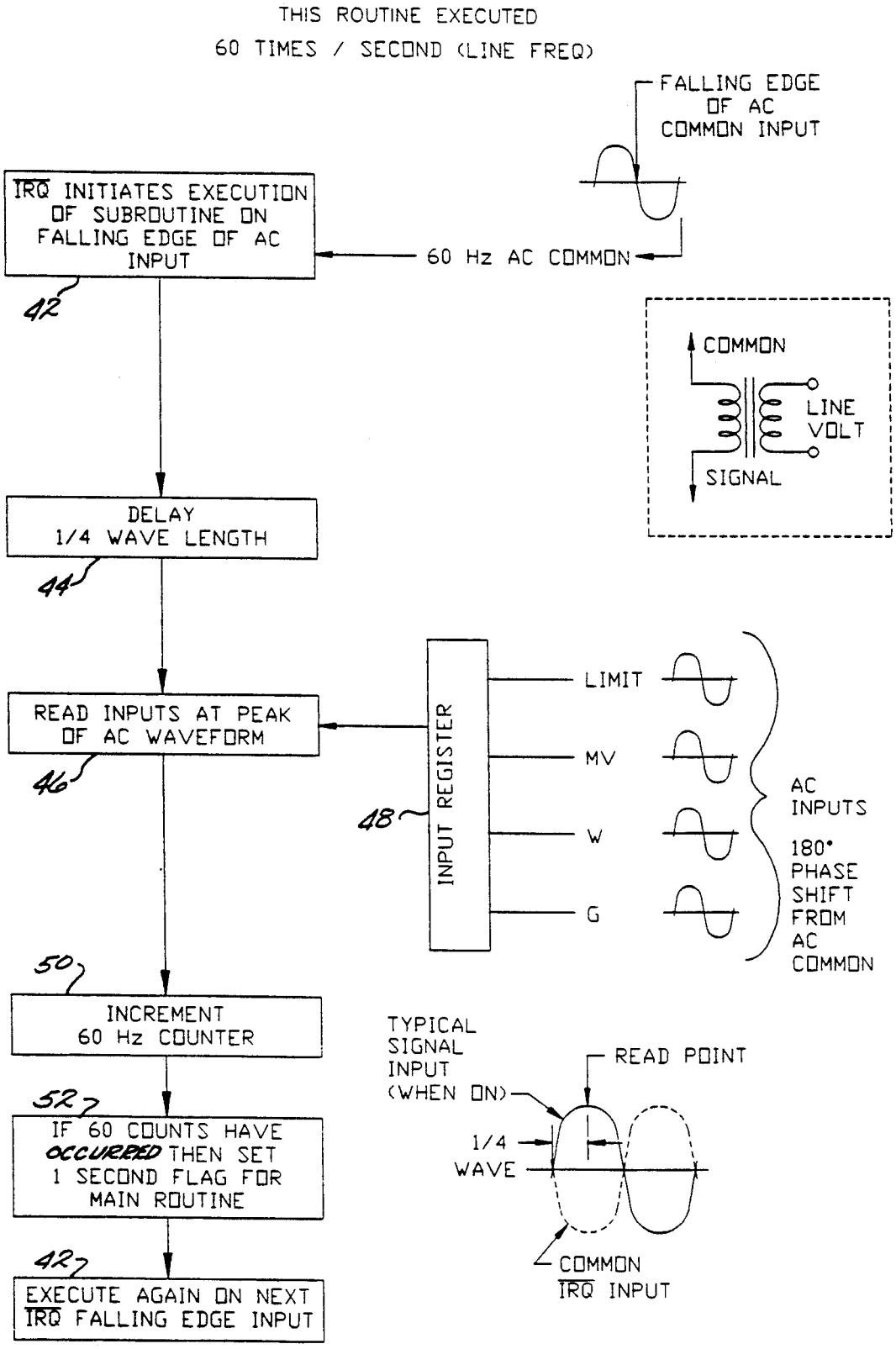
FIG. 4 shows key steps of an input reading routine used in accordance with the invention along with explanatory material inter-relating signal and common wave forms.

The 5 volt DC ground coming from the diode bridge is shown at port 10. With respect to DC ground the microprocessor sees a half wave which, because of the diode clamping is a square wave having the line frequency of 60 HZ, the phase of which depends on whether the W terminal is closed or open. When the terminal is closed the wave is 180° out of phase with the common voltage but when the terminal is open it is in phase with common voltage. In effect when the thermostat calls for heat a connection is made with the high side of the transformer, 180 degrees out of phase with common, and when it does not call for heat the connection is with the common of the transformer. AC common is connected to port 19, the IRQ or special interrupt port of microprocessor U2 through resistor R2. As indicated in FIG. 4, at the block, 42 the IRQ initiates execution of a subroutine whenever it is exposed to the falling edge of an AC input. Thus that routine is directly tied to common and is executed on every falling edge of the square wave. According to the routine, block 44, there is a delay of a quarter of a wave length and then the input port, in this case port 5, block 46, is read and inputted to the input register 48 for use in the main routine and a 60 HZ counter is incremented, block 50. After sixty counts, block 52, (i.e., one second) a flag is set so that the timing information can be transferred to the main routine. Thus the subroutine is executed with the input register 48 updated on every falling edge of the 60 HZ wave.

The specific delay of a quarter of a wave length is determined by the relationship between the microprocessor clock and the AC clock or frequency. At the beginning of the main routine while the interrupt is masked a subroutine reads the real time clock counter, then when the edge of the wave at port 19 goes high, an active low, the real time clock is read. When the IRQ goes low again (one cycle of the 60 HZ later) the real time clock is read again so that the number of clock pulses the oscillator has gone through during this cycle can be determined. The oscillator runs much faster, for example, in the order of 2 megahertz. The result, which varies from chip to chip, is used to synchronize the real time clock and the line clock and derive how many oscillations are in a quarter cycle. Once this calibration routine is accomplished a clear interrupt is generated so that the IRQ input is enabled to start working in the main program reading the input signals at the high point of the signal wave.

The relays are actuated asynchronously in order to have the contacts close randomly with respect to the AC line wave so that the load is more evenly distributed on the contacts. That is effected by using the real time or internal clock. A real time interrupt which counts directly from the oscillations at the real time clock sets a real time interrupt flag (RTIF) thereby generating an internal interrupt to execute a subroutine used for the output. When the real time interrupt flag is set the output section of the code is executed resulting in the asynchronous switching of the relay contacts.

Figure 5:
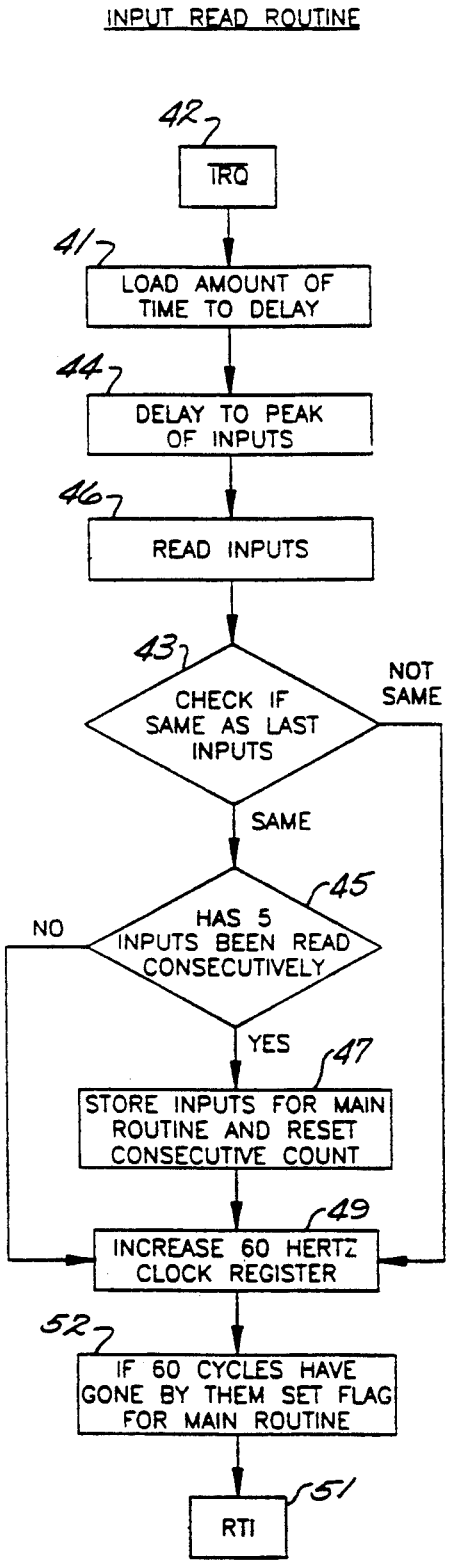
FIG. 5 is the input read routine of FIG. 4.

With respect to the specific routines, FIG. 5 shows the input read routine wherein the inputs are checked in relation to previous inputs to see if a sufficient number of good inputs have been read and if so a flag is set for the main routine. The routine is initiated at 42 with the time delay to the peak of the input wave at 41, 44 and the input read at 46. A decision block 43 checks to see if the input is the same as the previous inputs and if not the routine goes to processing block 49 which increases the 60 Hertz clock register. If the inputs are the same it moves to decision block 45 to see if 5 inputs have been read consecutively and if not again jumps to processing block 49. If 5 inputs have been read consecutively it goes to 47 storing inputs for the main routine and resets the consecutive count and then goes to block 49 and then, at 51 and 52 sets flag for the main routine.

Figure 6:
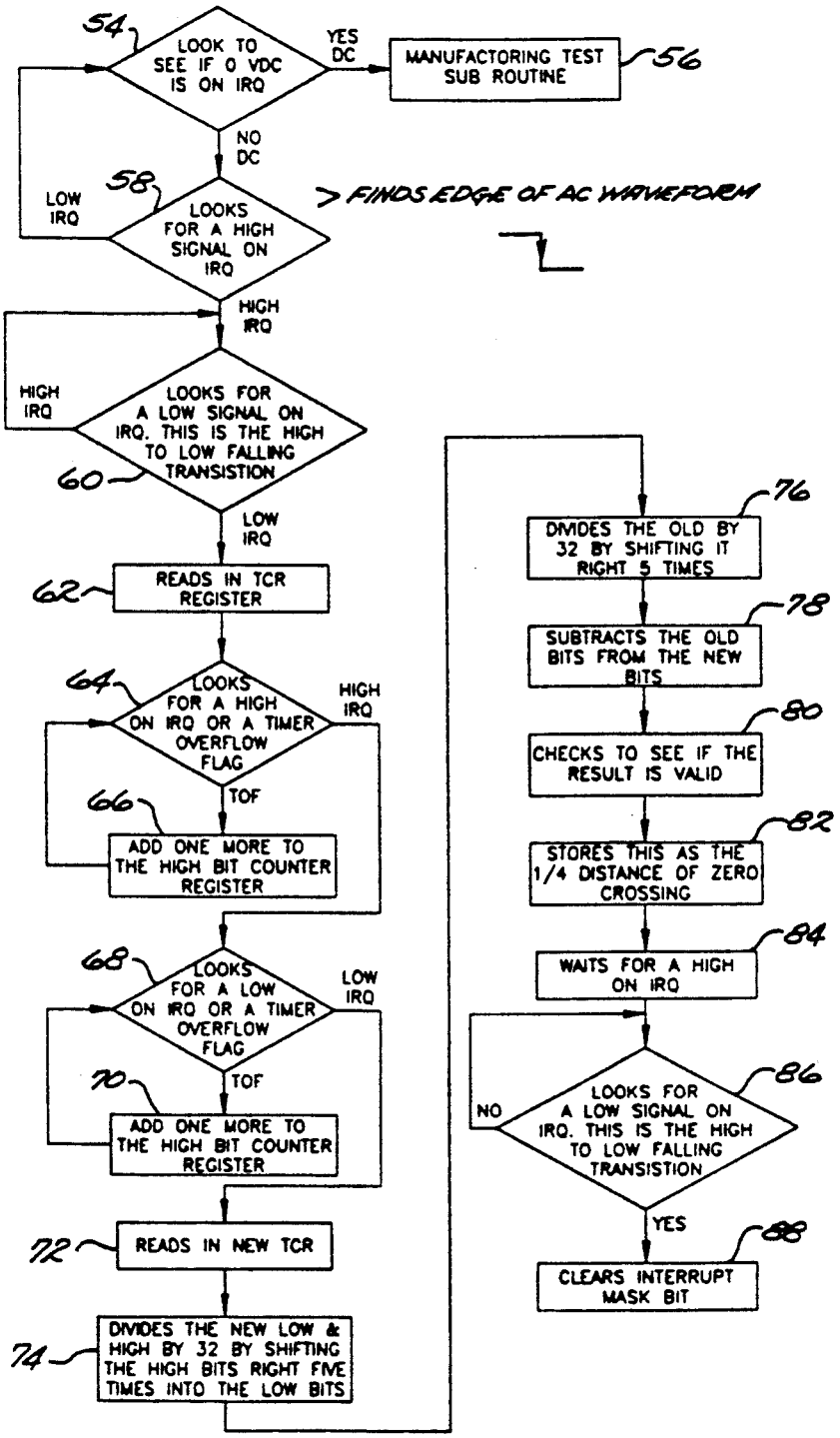
FIG. 6 is an input calibration routine used in accordance with the invention.

FIG. 6 shows the flow chart of the input calibration routine in which the IRQ port waits for a low to high transition to find the wave edge which is then read in the TCR register. Since the real time clock has limited capability overflows are counted in order to derive a quarter wave delay time. Essentially the number of internal clock cycles are counted for one AC clock cycle to go by from which the quarter wave delay time is derived. More specifically, the routine includes decision block 54 which checks to see if direct current is on IRQ port and if so goes into the manufacturing test subroutine 56. If not the routine goes to decision block 58 and looks for a high signal on IRQ port. If the signal is low it goes back to decision block 54 while if it is high it moves to decision block 60 where it looks for a high to low falling transition, i.e., a low signal on the IRQ port. If the signal is high it cycles around until it finds a low signal and moves to processing block 62 and reads into the TCR register and goes to decision block 64 where it looks for a high on IRQ port or a timer overflow flag. If it finds a timer overflow flag it adds one more to the high bit counter register at block 66 and goes back to decision block 64. If it finds a high on the IRQ port it goes to decision block 68 where it looks for a low on the IRQ port or a time overflow flag. If it finds a timer overflow flag it adds one to the high bit counter register at 70 and then goes back to decision block 68 and if it finds a low on the IRQ port it goes to block 72 and reads in new TCR and then to processing block 74 where it divides the new low and high by shifting the high bits right five times into the low bits and then to block 76 where it divides the old by 32 by shifting it right five times and in block 78 subtracts the old bits from the new bits and at processing block 80 checks to see if the result is valid and at block 82 stores this result as the one quarter distance from zero crossing and then, at block 84, waits for a high on the IRQ port. The routine then goes to decision block 86 and waits for a low signal, the high to low falling transition, on the IRQ port and then at 88 clears interrupt mask bit.

Figure 7:
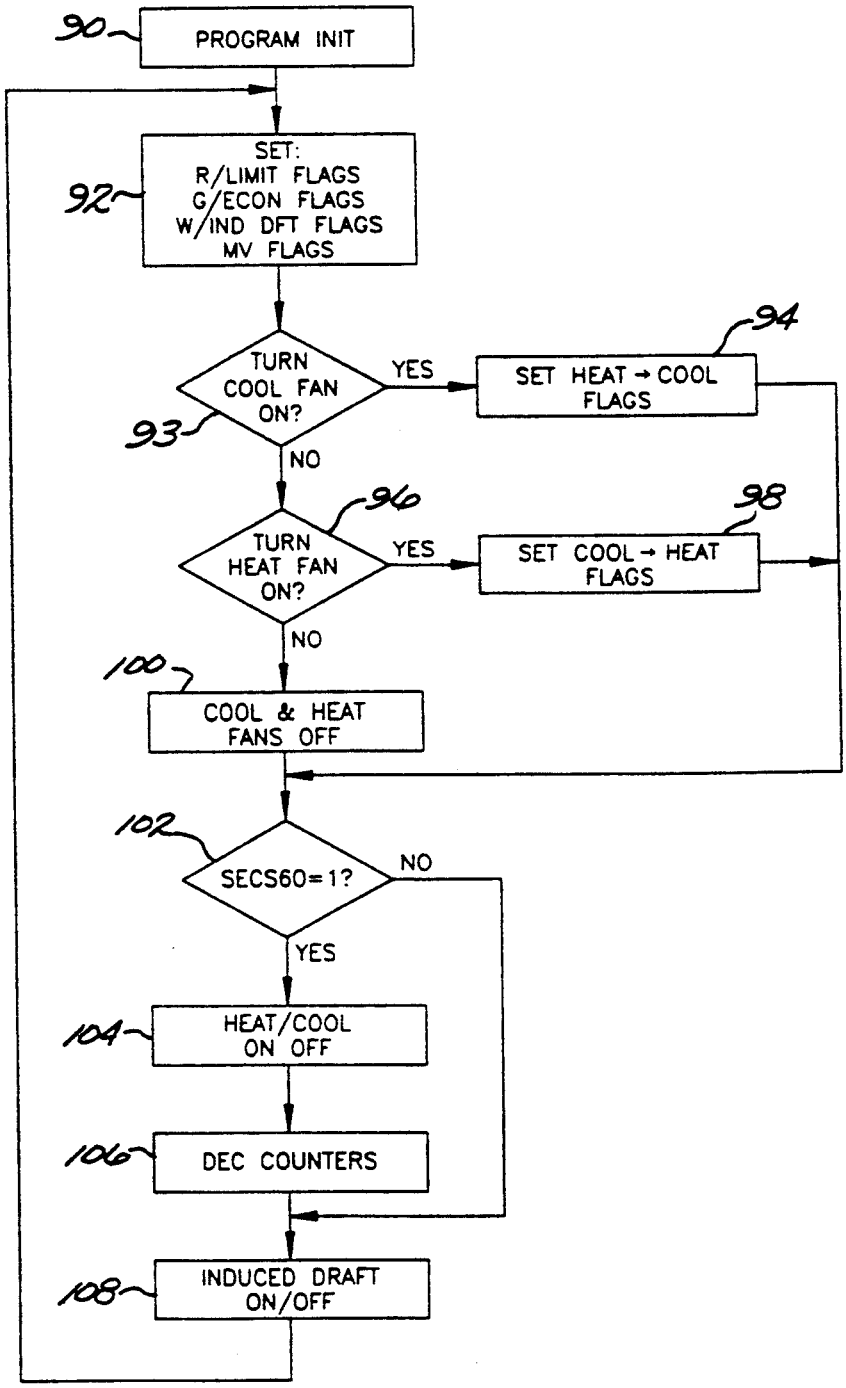
FIG. 7 is a main program overview.

FIG. 7 shows a simplified overview of the main program which assumes that everything is functioning as intended, i.e., the RTC (clock) is running, the interrupt routines are executing, etc. As the routine is initiated at 90 it takes the inputs and sets condition flags at 92. Then a decision is made at 93 whether the cool fan needs to be on and if so a flag is set at 94 to make the heat to cool transition. If the cool fan is not called for a decision is made at 96 regarding the turning on of the heat fan. If yes, the cool to heat transition flag is set at 98. If the heat fan is not called for then at 100 both heat and cool fans are off. It should be noted that the transitions are always set to avoid the possibilities that both receive a turn on signal at the same time. The routine then at 102 looks to see if one second has passed and if not goes to block 108. Every second the decrement counter is decremented turning the fans on and off as required at 104 and 106. The induced draft fan can be on at the same time the heat fan is on; therefore, it is not included in the sixty second routine. The flags are continuously checked but the induced fan is not turned on and off every second. If one of the flags is set, for example, a flag is set to change heat to cool, the first time through the routine heat speed receives an instruction to turn off for a second, then the next time through the instructions will be turn on the cool speed. This obviates contradictory signals. Whereas whenever the induced fan receives a signal to turn on it can do so without any delay.

Figure 8:
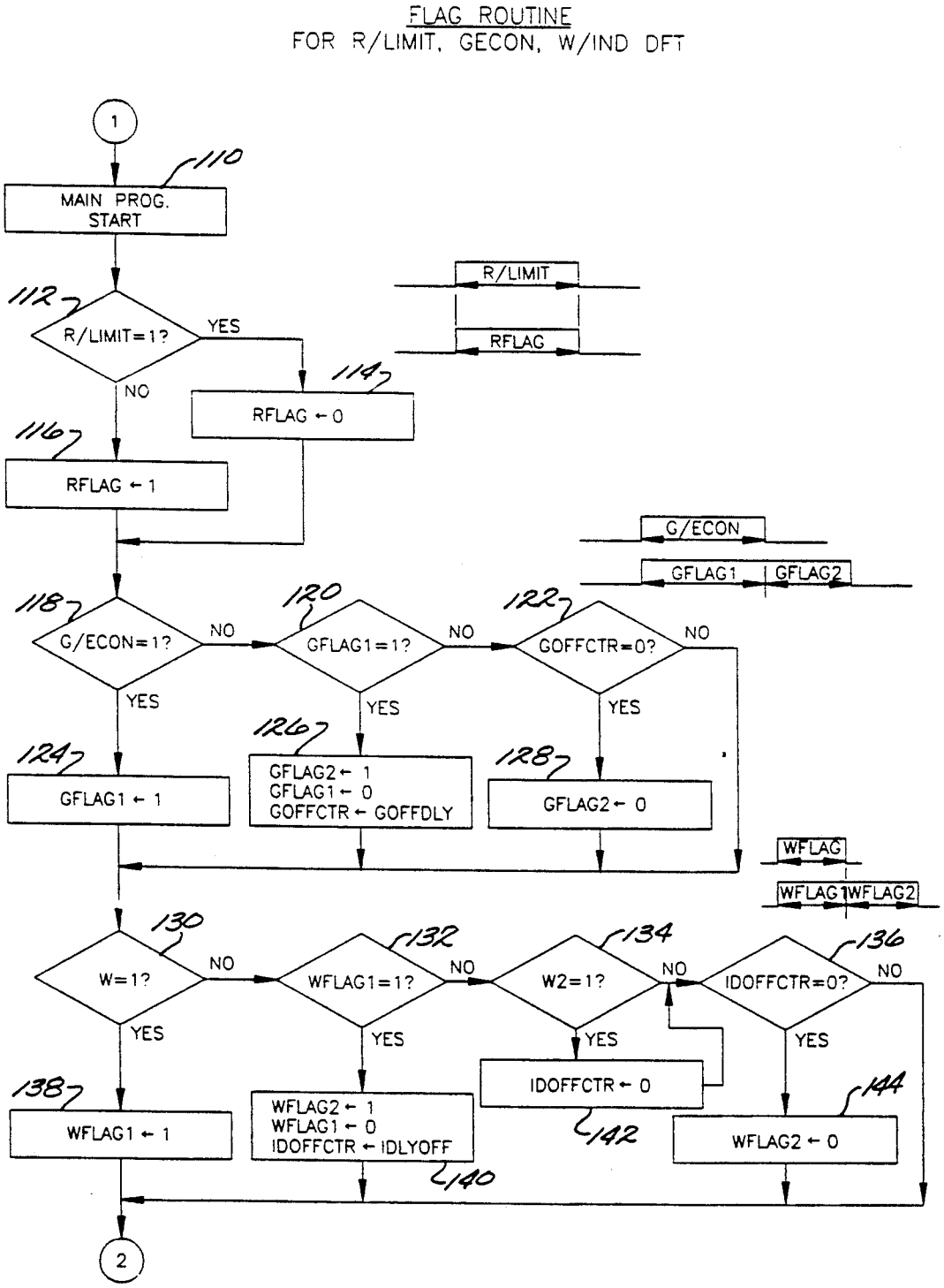
FIG. 8 is a flag routine for R/LIMIT, GECON; W/IND DFT.
Figure 9:
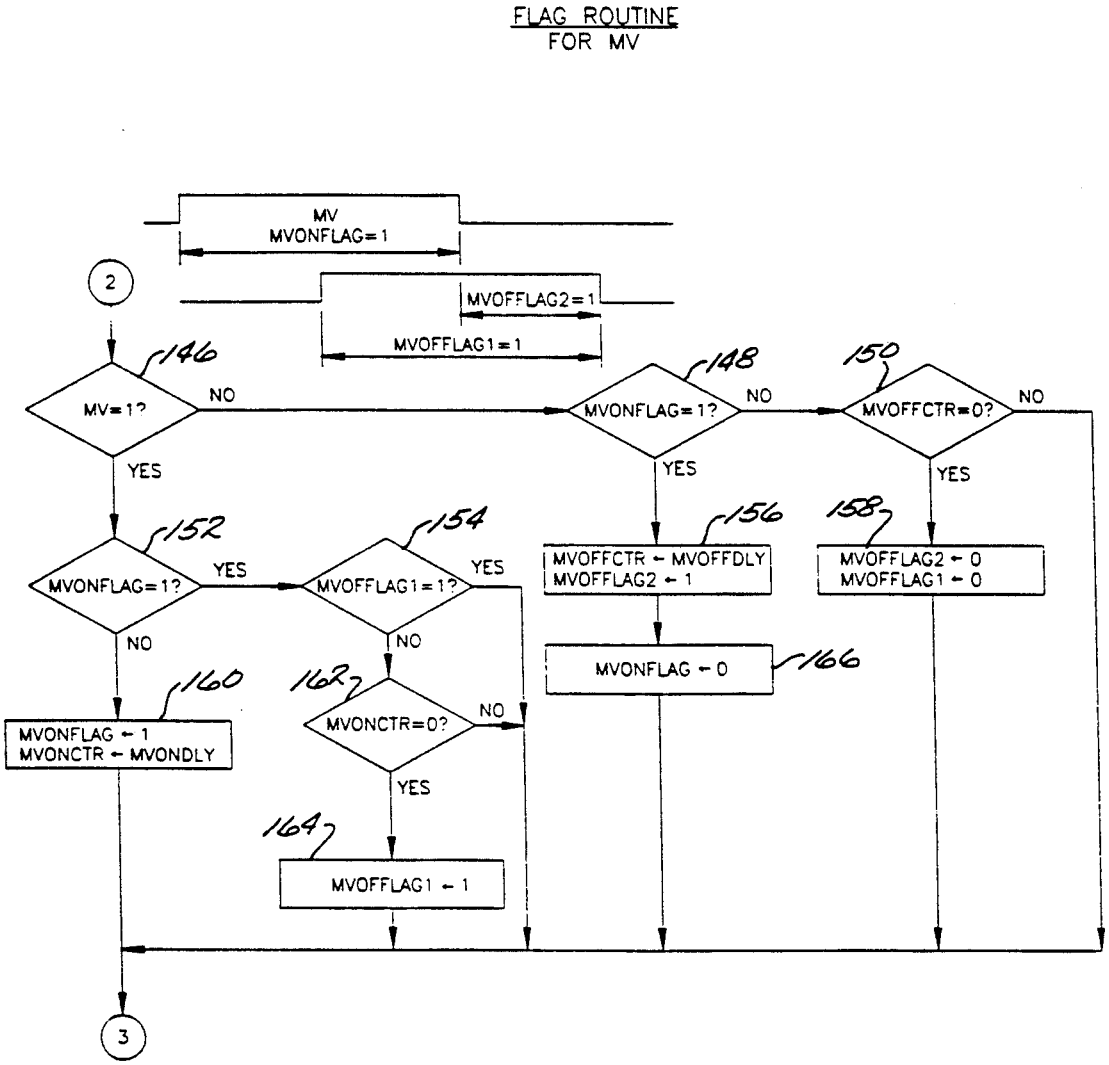
FIG. 9 is a flag routine for MV (main valve)

FIG. 8 shows the flag routine 110 for R/LIMIT, GECON and W/IND DFT and FIG. 9 for MV including decision and processing blocks 112–164 wherein the conditions of the limit flags are checked, what conditions they are in and where they have been in order to avoid the possibility of short cycling the routine and that the output routine has to finish completely. This is particularly important when some overlapping occurs, that is, competing signals for heat and cool speed fans. For example, the cool speed has a sixty second off delay and the heat speed a three minute off delay. The several flags keep track of these various conditions.

Figure 10:
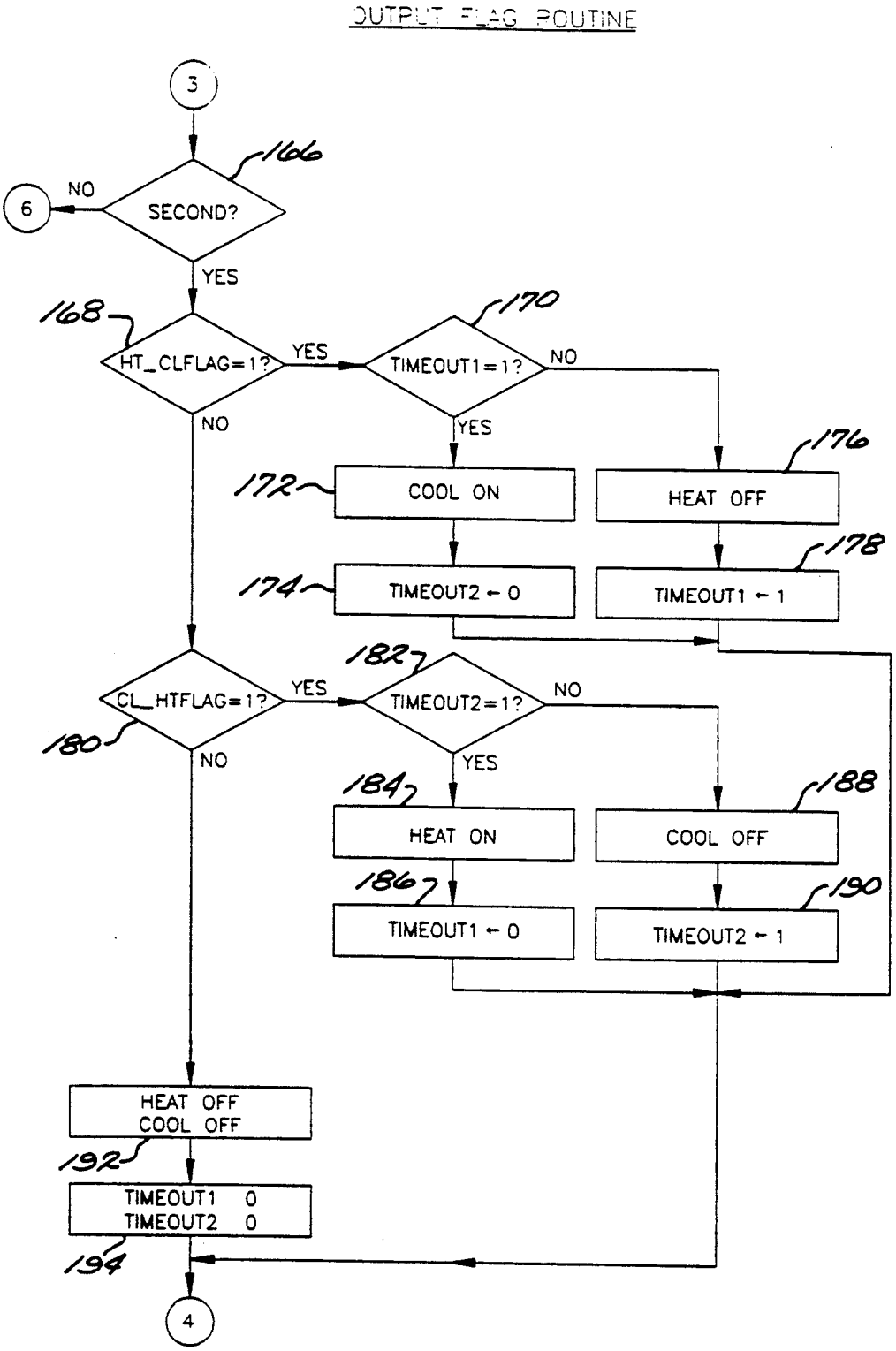
FIG. 10 is an output flag routine.

FIG. 10 relating to the output flag routine and including decision and processing blocks 166–914 ensures that the proper sequence of events occurs. That is, that the heat speed is turned off before the cool speed is turned on and the like.

Figure 11:
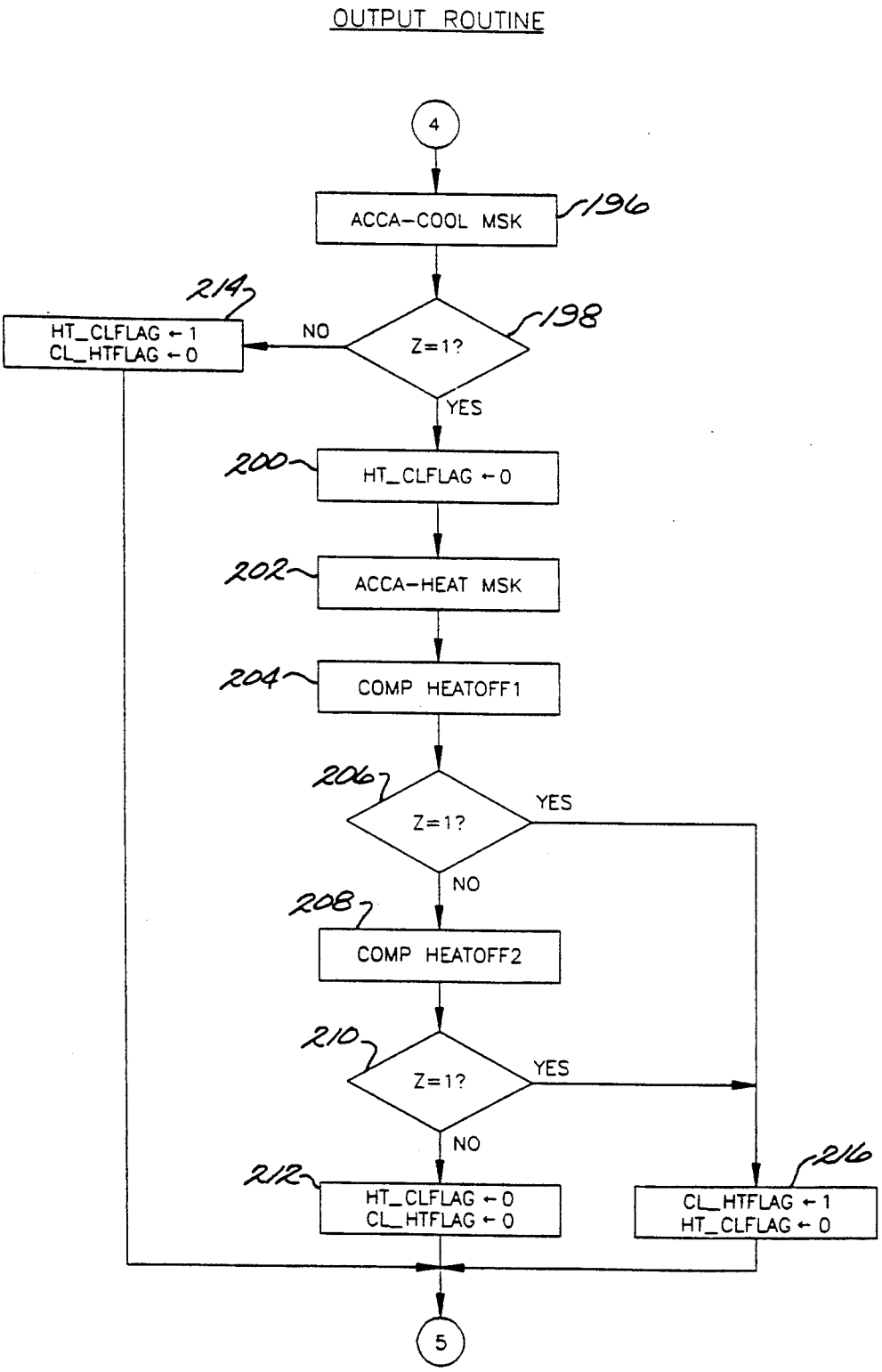
FIG. 11 is an output routine.
Figure 12:
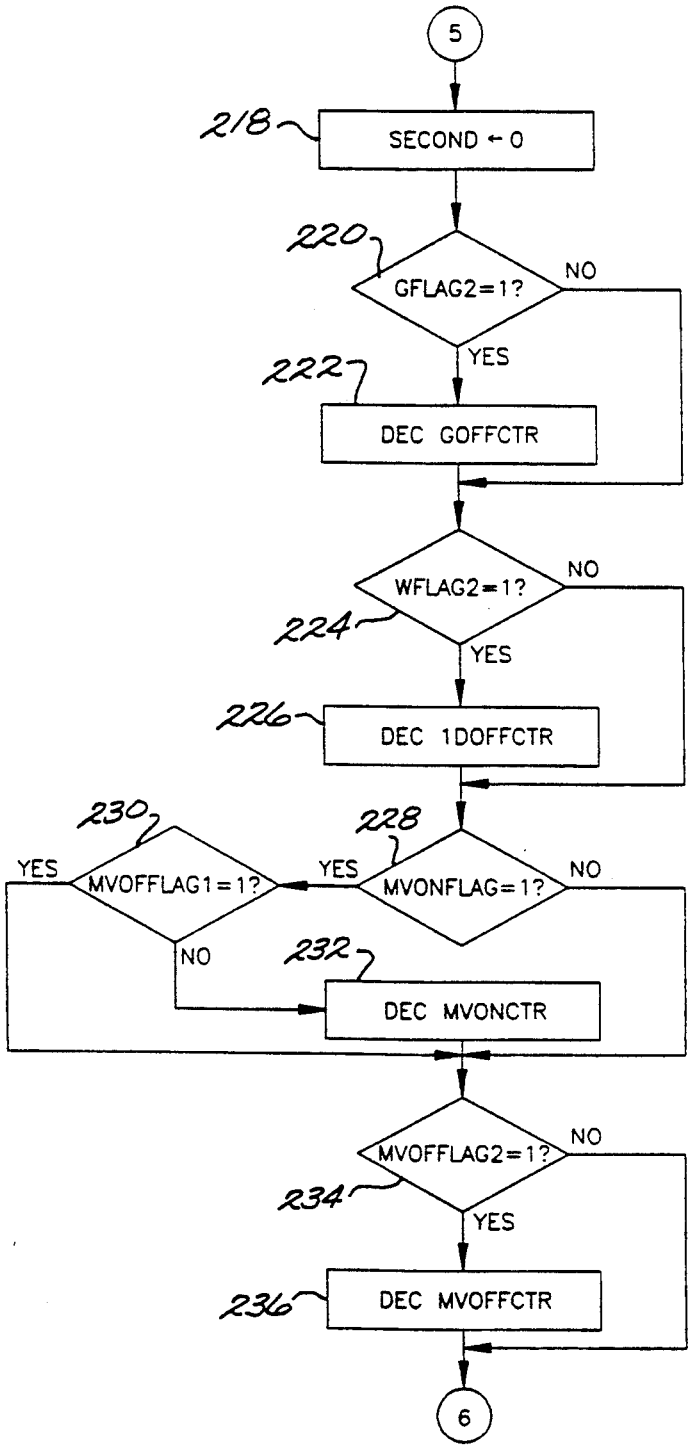
FIG. 12 is a counter routine.

FIGS. 11 and 12 show the output and counter routines respectively including decision and processing blocks 196–236 in which flags are set to transfer the output register in the RTI interrupt routine. Based on the conditions determined by a flag, e.g., if in time delay off then the counter is decremented, if not the routine skips to the next item.

Figure 13:
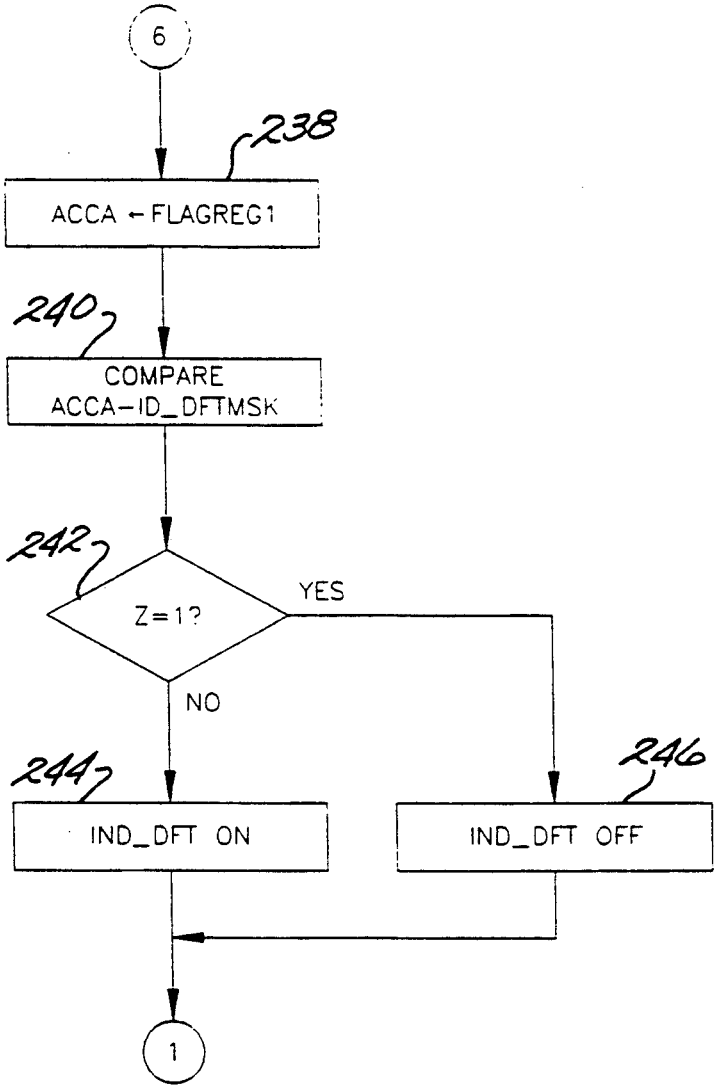
FIG. 13 is an induced draft output routine.

It will be seen in FIG. 13, relating to the induced draft output routine including processing blocks 238, 240, 244 and 246 and decision block 242, that competing speeds are not factors so that the 1 second flags is not a factor.

FIG. 14 shows the several counters and flags and their location in memory including flag register 1-248, inputs 250, flag register 2-252 and outputs 254 while FIGS. 15, 16 and 17 are truth tables of the inputs and outputs of heat and cool speeds and induced draft fan respectively.

Figure 18:
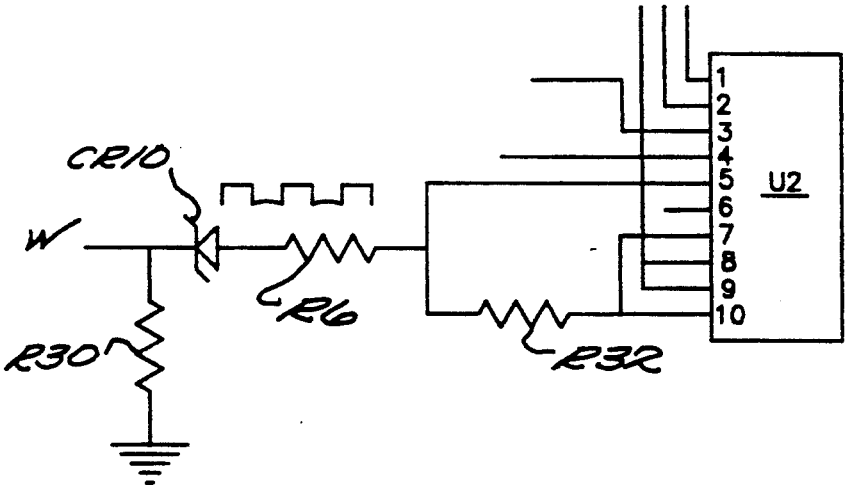
FIG. 18 shows a portion of the FIG. 2 schematic modified to provide electronic thermostat compatibility.

A modified embodiment is shown in FIG. 18 to make the control compatible for use with electronic thermostats. Electronic thermostats conventionally use one of the live thermostat lines as common and as long as the outputs have low impedance this does not cause a problem; however, when used with electronics of the type employed in the instant invention the two milliamperes or so of current can cause unintended operation, particularly in the heat request signal line in which the conventional time delay relays have been obviated by the circuit made in accordance with the invention. One way of dealing with this is to use a small pull down resistor, e.g., 500 ohms. In accordance with the modified embodiment a relatively small resistor R30, for example, a 2 watt resistor of 470 ohms, connects line W to AC ground. This will result in approximately twelve to fifteen milliamps which can still result in a wave form which has a hill in between consecutive highs when the thermostat line is closed. The addition of a 12 volt zener diode CR10 prevents turn on unless the voltage exceeds 12 volts so even if the electronic thermostat causes 20 milliamps there will only be seven or eight volts on the high side of the resistor R30 which will be insufficient to turn on diode CR10. Back to back zeners are not necessary since only the positive half of the wave form is considered as an input in the control of the present invention. This compatibility is achieved by modifying the FIG. 2 embodiment by a change in a resistor and the addition of a zener diode for the W and G signal lines. The two watt resistors can be accommodated conveniently by cutting a hole in the circuit board in alignment with each resistor to prevent overheating of the board. It is also preferable to add resistor R32 between port 5 of microprocessor U2 and DC ground, port 10 to prevent any spike of leakage current from causing a problem.

A control circuit made in accordance with FIG. 2 embodiment comprised the following components.

| | | | | | |
|---|---|---|---|---|---|
| R1 | 1.5K ohms 5% IW | R11 | 39K ohms 5% 1/8W | CR7 | 5.0 V zener |
| R2 | 100K ohms 5% 1/8W | R12 | 1.5K ohms 5% 1W | CR1 | general purpose diode |
| R3 | 100K ohms 5% 1/8W | R13 | 1.5K ohms 5% IW | CR2 | general purpose diode |
| R4 | 100K ohms 5% 1/8W | R14 | 1.5K ohms 5% 1W | CR3 | general purpose diode |
| R5 | 50K ohms 5% 1/8W | R15 | 10K ohms 5% 1/8W | CR4 | general purpose diode |
| R6 | 100K ohms 5% 1/8W | R16 | 10K ohms 5% 1/8W | CR5 | general purpose diode |
| R7 | 50K ohms 5% 1/8W | R17 | 10K ohms 5% 1/8W | CR6 | switching diode |
| R8 | 100K ohms 5% 1/8W | C1 | 10uf 63VDC | U1 | MG8HC05J1 Motorola |
| R9 | 100K ohms 5% 1/8W | C2 | .1uf 50VDC | U2 | ULN 2003A Texas Instruments |
| R10 | 10K ohms 5% 1/8W | | | K1 | T90 Potter & Brumfield |
| | | | | K2 | T90 Potter & Brumfield |
| | | | | K3 | T70 Potter & Brumfield |

Numerous variations and modifications of the invention will become readily apparent to those familiar with furnace controls. The invention should not be considered as limited to the specific embodiments depicted, but rather as defined in the claims.

The LST file is set forth below:

```
M6805 Portable Cross Assembler  0.05   MS-DOS/PC-DOS  Page 1
 Fri Sep 20 16:20:06 1991
Command line:
 ..\PASM05.EXE -dxs -l ..\lstfiles\2GFMAIND.lst 2GFMAIND.asm
Options list:
ON  - b - Printing of macro definitions
ON  - c - Printing of macro calls
ON  - d - Placing of symbolic debugging information in COFF  (changed)
OFF - e - Printing of macro expansions
ON  - f - Printing of conditional directives
OFF - g - Printing of generated constants list
OFF - q - Expanding and printing of structured syntax
ON  - s - Printing of symbol table  (changed)
OFF - u - Printing of conditional unassembled source
ON  - x - Printing of cross reference table  (changed)
OFF - m - Suppress printing of error messages
ON  - w - Printing of warning messages
OFF - v - Suppress printing of updated status
OFF - y - Enabling of sgs extensions
ON  - o - Create object code
ON  -   - Formatting of source line listing
Create listing file - l - ..\lstfiles\2GFMAIND.lst

Xdefs:
  NONE

Xrefs:
  NONE

Input file(s): 2GFMAIND.asm (99 lines)
               D:\6805\PASM\2GF\J1EQU.ASM (29 lines) D:\6805\PASM\2GF\INTEREQC.ASM (22 lines)
               D:\6805\PASM\2GF\2GFEQUC.ASM (66 lines) D:\6805\PASM\2GF\INTERRMC.ASM (35 lines)
               D:\6805\PASM\2GF\2GFRMBC.ASM (34 lines) D:\6805\PASM\2GF\CRCVALC.ASM (17 lines)
               D:\6805\PASM\2GF\RAMCHKC.ASM (60 lines) D:\6805\PASM\2GF\CRCHK.ASM (64 lines)
               D:\6805\PASM\2GF\INTERINC.ASM (78 lines) D:\6805\PASM\2GF\CALIBC.ASM (65 lines)
               D:\6805\PASM\2GF\2GFMTSTC.ASM (116 lines) D:\6805\PASM\2GF\2GFRC.ASM (347 lines)
               D:\6805\PASM\2GF\INPUTC.ASM (107 lines) D:\6805\PASM\2GF\OUTPUT.ASM (23 lines)
               D:\6805\PASM\2GF\RROMBYTE.ASM (25 lines) D:\6805\PASM\2GF\2GFPNCPD.ASM (22 lines)
               D:\6805\PASM\2GF\J1VCTRS.ASM (19 lines)

Output file: 2GFMAIND.o
Listing file: ..\lstfiles\2GFMAIND.lst


M6805 Portable Cross Assembler  0.05  2GFMAIND.asm  Page 2
 Fri Sep 20 16:20:06 1991
Options - MD,MC,NOG,NOU,W,NOMEX,CL,FMT,O

LINE   S PC   OPCD OPERANDS S LABEL    MNEMO OPERANDS COMMENT
00001                       ***************************************************************************
00002                       *                                                                         *
00003                       *     MODULE NAME : 2GFMAIN.ASM                                           *
00004                       * ORIGINAL AUTHOR : MARK EIFLER                                           *
00005                       *         PURPOSE : THIS IS THE MAIN PROGRAM SECTION (LINKER SOURCE)      *
00006                       *                   FOR THE 2GF BOARD MOTOROLA MC68HC05J1 MICRO-CONTROLLER *
00007                       *                                                                         *
00008                       *      DATE      REV    REVISOR    CHANGES MADE                           *
00009                       *      ----      ---    -------    ------------                           *
00010                       *      3-16-91    A      N/A       INITIAL VERSION                        *
00011                       *                                                                         *
00012                       ***************************************************************************
```

```
00013
00014                    ***********************************************************************
00015                    *                          PASM DIRECTIVES SECTION                    *
00016                    ***********************************************************************
00017
00018                              OPT   MUL     ENABLES THE MUL INSTRUCTION
00019
00020                    ***********************************************************************
00021                    *                              EQUATES SECTION                        *
00022                    ***********************************************************************
00023
00024                              INCLUDE D:\6805\PASM\2GF\J1EQU.ASM J1 EQUATES MODULE
00001                              OPT   NOL
00015                              OPT   L
00016
00017  P 0000    0000    A PORTA    EQU   $00     PORTA IS AN I/O PORT, 8 BITS
00018  P 0000    0001    A PORTB    EQU   $01     PORTB IS AN I/O PORT, 6 BITS
00019  P 0000    0004    A DDRA     EQU   $04     DIRECTION REG. FOR PORTA
00020  P 0000    0005    A DDRB     EQU   $05     DIRECTION REG. FOR PORTB
00021                    *                              1's FOR OUTPUTS & 0's FOR INPUTS
00022  P 0000    0008    A TCSR     EQU   $08     TIMER CONTROL & STATUS REGISTER
00023                    *                              TOF,RTIF,TOFE,RTIE,0,0,RT1,RT0
00024  P 0000    0009    A TCR      EQU   $09     TIMER COUNTER REGISTER
00025  P 0000    07f0    A WDOG     EQU   $07F0   WRITING A 0 TO BIT 0 CLEARS WATCH
00026  P 0000    00c0    A J1RAM    EQU   $00C0   J1 RAM LOCATIONS $00C0 - $00FF
00027  P 0000    0302    A J1ROM    EQU   $0302   J1 ROM LOCATIONS $0300 - $06FF
00028  P 0000    07f8    A J1VCTRS  EQU   $07F8   J1 VECTORS LOCATIONS $07F0 - $07FF
00029  P 0000    06ff    A ROMEND   EQU   $06FF   END OF AVAILABLE ROM
00025
00026                              INCLUDE D:\6805\PASM\2GF\INTEREQC.ASM INTERFACE EQUATES
00001                              OPT   NOL
00014                              OPT   L
00015
00016  P 0000    0001    A ONE      EQU   $01     DECIMAL 1 USED IN THE CALIBRATION MODULE
00017  P 0000    0006    A SIX      EQU   $06     DECIMAL 5 USED IN THE CALIBRATION MODULE
00018  P 0000    003b    A SIXTY    EQU   59      DECIMAL 60-1 USED IN THE INPUTS MODULE
00019  P 0000    0010    A MINCLOCK EQU   $10     MINIMUM CLOCK VALUE ALLOWED
00020  P 0000    0090    A MAXCLOCK EQU   $90     MAXIMUM CLOCK VALUE ALLOWED
00021  P 0000    0019    A FAULTS   EQU   25
00022  P 0000    0008    A CONCNT   EQU   8
00027                    *                                                  MODULE
00028
00029                              INCLUDE D:\6805\PASM\2GF\2GFEQUC.ASM 2GF EQUATES MODULE
00001                              OPT   NOL
00014                              OPT   L
00015
00016  P 0000    003c    A GOFFDLY  EQU   &60     60 SECOND G_ECON DLY OFF
00017  P 0000    0004    A GONDLY   EQU   &4
00018  P 0000    0004    A IDLYON   EQU   &4
00019  P 0000    001c    A IDLYOFF  EQU   &28     90 SECOND IND_OFT DLY
00020  P 0000    0078    A ONTIME   EQU   &120
00021  P 0000    003c    A WAITIME  EQU   &60
00022  P 0000    001e    A MVONDLY  EQU   &30     30 SECOND MV DLY HEAT ON
00023  P 0000    00b4    A MVOFFDLY EQU   &180    180 SECOND MV DLY HEAT
00024  P 0000    0060    A COOLMASK EQU   %01100000 MASK ALL BUT GFLAG1,GFLAG2
00025  P 0000    0087    A HEATMASK EQU   %10000111 MASK ALL BUT RFLAG,MVONFLAG,
00026  P 0000    0081    A HEAT1    EQU   %10000001
00027  P 0000    0080    A HEAT2    EQU   %10000000
00028  P 0000    0081    A ID1DFTMSK1 EQU %10000001
00029  P 0000    0080    A ID1OFFMSK1 EQU %10000000
00030  P 0000    0012    A ID2DFTMSK2 EQU %00010010
00031  P 0000    0000    A ID2OFFMSK2 EQU %00000000
00032  P 0000    00a6    A RAMTST   EQU   $A6
00033
00034                    ***************************************************************
00035                    *
00036                    *   DEFINE BIT DESIGNATIONS
00037                    *
00038                    ***************************************************************
00039
00040                    * DEFINITIONS FOR FLAGREG3
00041
00042  P 0000    0000    A WONFLAG  EQU   0
00043  P 0000    0001    A WOFFLAG1 EQU   1
00044  P 0000    0002    A WOFFLAG2 EQU   2
00045  P 0000    0003    A STRTIMER EQU   3
00046  P 0000    0004    A ONFLAG   EQU   4
00047  P 0000    0005    A GONFLAG  EQU   5
00048
00049                    * DEFINITIONS FOR FLAGREG1
00050
00051  P 0000    0006    A GFLAG1   EQU   6
00052  P 0000    0000    A MVONFLAG EQU   0
```

BEST AVAILABLE

```
00053
00054
00055                          * DEFINITIONS FOR PORTA
00056
00057  P 0000      0001     A PILOTDFT EQU   1
00058  P 0000      0002     A MFGMODE  EQU   2
00059  P 0000      0003     A NODFTDLY EQU   3
00060
00061                          * DEFINITIONS FOR OUTPUT BUFFER "OUTPUTS"
00062
00063  P 0000      0007     A LED      EQU   7
00064
00065
00066
00030
00031                          ***********************************************************************
00032                          *                          RAM STORAGE ORIGINATION POINT                *
00033                          ***********************************************************************
00034
00035  A 00c0                          ORG   J1RAM    RAM LOCATIONS $C0 - $FF
00036
00037                          ***********************************************************************
00038                          *                          RAM RESERVATION SECTION                      *
00039                          ***********************************************************************
00040
00041                                   INCLUDE D:\6805\PASM\2GF\INTERRMC.ASM INTERFACE RMB's MODULE
00001                                   OPT   NOL
00014                                   OPT   L
00015
00016  A 00c0      01       A RTCLOCK  RMB   1        1/4 DISTANCE OF 60 HZ WAVE
00017  A 00c1      01       A RTCHIBIT RMB   1        HIGH BITS TO THE TCR
00018  A 00c2      01       A LASTIN1  RMB   1        LAST INPUT READ IN
00019  A 00c3      01       A LASTIN2  RMB   1        LAST NONCONFORMING INPUT VALUE
00020  A 00c4      01       A NEWCNT   RMB   1        LIMIT OF NON CONFORMING INPUTS
00021  A 00c5      01       A NEWSAME  RMB   1        NUMBER OF CONSECUTIVE GOOD READS
00022  A 00c6      01       A NUMCHK   RMB   1        NUMBER OF INPUT CYCLES TO COMPARE
00023  A 00c7      01       A INPUTS   RMB   1        INPUTS TO PASS TO OTHER PROGRAMS
00024  A 00c8      01       A OUTPUTS  RMB   1        OUTPUTS RECEIVED FROM APPLICATION
00025  A 00c9      01       A HZ60     RMB   1        60 HZ COUNTER
00026  A 00ca      01       A SEC60    RMB   1        1 SECOND SET BIT
00027  A 00cb      01       A PULSES   RMB   1        PULSES LEFT TO BEFORE 1 SEC IS UP
00028  A 00cc      01       A CYCLEFT  RMB   1        DEBOUNCED CYCLES LEFT BEFORE VALID
00029  A 00cd      0a       A RROMBYTE RMB   10       RAM IMAGE OF CRC CHECK
00030  A 00d7      02       A CRC      RMB   2        CRC CHECK VALUE REGISTER
00031  A 00d9      01       A BITCNT   RMB   1        BIT COUNTER REGISTER
00032  A 00da      01       A IRQCNT   RMB   1        NUMBER OF INTERRUPTS COUNTED WITHOUT MAIN
00033  A 00db      01       A TCSRMASK RMB   1        TCSR MASK REGISTER
00034  A 00dc      01       A NUMCHK2  RMB   1
00035  A 00dd      01       A NOISECNT RMB   1        NOISE INTERRUPT COUNTS
00042
00043                                   INCLUDE D:\6805\PASM\2GF\2GFRMBC.ASM 2GF RMB's MODULE
00001                                   OPT   NOL
00014                                   OPT   L
00015
00016  A 00de      01       A FLAGREG1 RMB   1        INPUT FLAG REGISTERS
00017  A 00df      01       A FLAGREG2 RMB   1        OUTPUT FLAG REGISTERS
00018  A 00e0      01       A FLAGREG3 RMB   1        INDUCED DRAFT FLAG REG
00019  A 00e1      01       A MVONREG  RMB   1        MVON REGISTER ADDRESS
00020  A 00e2      01       A GOFFREG  RMB   1        GOFF REGISTER ADDRESS
00021  A 00e3      01       A IDOFFREG RMB   1        IND DFT REGISTER ADDRESS
00022  A 00e4      01       A MVOFFREG RMB   1        MVOFF REGISTER ADDRESS
00023  A 00e5      01       A TEST     RMB   1        TEST CODE REGISTER
00024  A 00e6      01       A SWICTR   RMB   1        SWI COUNTER REGISTER
00025  A 00e7      01       A 060CNTS  RMB   1        MINUTE COUNTER
00026  A 00e8      01       A WONCTR   RMB   1        DLY ON DRAFT COUNTER
00027  A 00e9      01       A ST_TIMER RMB   1        PILOT DRAFT OPTION IDLE TIMER
00028  A 00ea      01       A ONTIMCTR RMB   1        PILOT DRAFT OPTION         ON TIMER
00029  A 00eb      01       A GONCTR   RMB   1        GONDLY COUNTER
00030  A 00ec      01       A HILOCNT1 RMB   1        TIME DELAY FOR AC DETERMINATION
00031  A 00ed      01       A HILOCNT2 RMB   1
00032  A 00ee      01       A MEMCHK   RMB   1
00033  A 00ef      01       A INITEST  RMB   1
00034
00044
00045                          ***********************************************************************
00046                          *                          CALCULATED CRC VALUE                         *
00047                          ***********************************************************************
00048
00049                                   INCLUDE D:\6805\PASM\2GF\CRCVALC.ASM CRC VALUE
00001                                   OPT   NOL
00014                                   OPT   L
00015
00016  A 0300                          ORG   $300
```

```
00017  A 0300      0f46     A          FDB   $0F46     CRC VALUE
00050
00051                                 ***********************************************************************
00052                                 *                    PROGRAM ORIGINATION POINT (ROM)                  *
00053                                 ***********************************************************************
00054
00055
00056  A 0302                         ORG   J1ROM     ROM LOCATIONS $0300 - $06FF
00057
00058                                 ***********************************************************************
00059                                 *                              PROGRAM SECTION                        *
00060                                 ***********************************************************************
00061
00062                                 INCLUDE D:\6805\PASM\2GF\RAMCHKC.ASM RAM CHECK ROUTINE
00001                                 OPT   NOL
00015                                 OPT   L
00016
00017                                 ******************************************
00018                                 *       RAM VERIFICATION ROUTINE         *
00019                                 ******************************************
00020
00021  A 0302 9c                      RESETV RSP            RESET STACK POINTER
00022  A 0303 5f                      CLRX
00023  A 0304 cf   07f0     A          STX   WDOG      PET THE WATCH DOG
00024
00025  A 0307 a6   07       A          LDA   #7
00026  A 0309 b7   c6       A          STA   NUMCHK
00027  A 030b 3f   ee       A          CLR   MEMCHK
00028  A 030d ae   ef       A          LDX   #INITEST
00029  A 030f f6                RAM    LDA   ,X        If the ram is scrambled, reinitilatize it,
00030  A 0310 bb   ee       A          ADD   MEMCHK
00031  A 0312 b7   ee       A          STA   MEMCHK    if not, then jump to calibration routine
00032  A 0314 5c                       INCX
00033  A 0315 3a   c6       A          DEC   NUMCHK
00034  A 0317 27   02     031b         BEQ   CMPARE
00035  A 0319 20   f4     030f         BRA   RAM
00036
00037  A 031b b1   a6       A CMPARE   CMP   RAMTST
00038  A 031d 26   03     0322         BNE   GO_ON
00039  A 031f cc   03ba     A          JMP   INITEND
00040
00041  A 0322 a6   55       A GO_ON    LDA   #$55
00042  A 0324 ae   c0       A RAMCHK4  LDX   #J1RAM    PUT RAM START ADDRESS IN INDEX
00043
00044  A 0326 f7                RAMCHK1 STA   0,X       STORE ACCA IN RAM ADDRESS
00045  A 0327 f1                       CMPA  0,X       DOES THE RAM VALUE EQUATE TO THE
00046  A 0328 27   04     032e         BEQ   RAMCHK2   STORED VALUE?
00047  A 032a ae   a0       A          LDX   #$A0      LOAD FAILURE CODE
00048  A 032c 20   0b     0339         BRA   RAMCHKEND END CHECK
00049
00050  A 032e 5c                RAMCHK2 INCX
00051  A 032f 26   f5     0326         BNE   RAMCHK1   IF INDEX DOES NOT TURN OVER TO $00
00052                                 *                          LOOP BACK TO RAMCHK1
00053
00054  A 0331 a1   aa       A          CMP   #$AA      IF ACCA IS =$AA, THEN THE ROUTINE
00055  A 0333 27   04     0339         BEQ   RAMCHKEND IS COMPLETE!
00056
00057  A 0335 a6   aa       A          LDA   #$AA      CONTINUE THE TEST WITH $AA IN ALL RAM
00058  A 0337 20   eb     0324         BRA   RAMCHK4   START OVER WITH NEW VALUE IN ACCA
00059
00060  A 0339 bf   e5       A RAMCHKEND STX  TEST
00063
00064                                 INCLUDE D:\6805\PASM\2GF\CRCHK.ASM CRC CHECK ROUTINE
00001                                 OPT   NOL
00016                                 OPT   L
00017
00018                                 * ROUTINE TO COPY ROM IMAGE INTO RAM
00019
00020  A 033b 5f                      CLRX
00021  A 033c d6   06d4     A NEXT     LDA   RMIMAGE,X
00022  A 033f e7cd                     STA   RROMBYTE,X
00023  A 0341 5c                       INCX
00024  A 0342 a3   0a       A          CMPX  #10
00025  A 0344 23   f6     033c         BLS   NEXT
00026
00027  A 0346 3f   d7       A GENCRC   CLR   CRC       CRC=0
00028  A 0348 3f   d8       A          CLR   CRC+1
00029  A 034a bd   cd       A GENCRC1  JSR   RROMBYTE GET A BYTE OF ROM
00030  A 034c b8   d7       A          EOR   CRC       CRC=CRC^(ROMBYTE<<8)
00031  A 034e b7   d7       A          STA   CRC
00032  A 0350 a6   08       A          LDA   #8        FOR(I=8,I=0,--I)
00033  A 0352 b7   d9       A          STA   BITCNT
00034  A 0354 5f                       CLRX            PET THE WATCH DOG
```

```
00035  A 0355 cf   07f0    A          STX   WDOG
00036
00037  A 0358 38   d8      A CRCGEN2  LSL   CRC+1     CRC=CRC<<1
00038  A 035a 39   d7      A          ROL   CRC
00039  A 035c 24   0c    036a         BCC   CRCGEN3   WAS THE MS BIT OF OLD CRC=1?
00040  A 035e a6   21      A          LDA   #$21      YES,CRC=CRC^$1021
00041  A 0360 b8   d8      A          EOR   CRC+1
00042  A 0362 b7   d8      A          STA   CRC+1
00043  A 0364 a6   10      A          LDA   #$10
00044  A 0366 b8   d7      A          EOR   CRC
00045  A 0368 b7   d7      A          STA   CRC
00046
00047  A 036a 3a   d9      A CRCGEN3  DEC   BITCNT    DONE FOR ALL 8 BITS OF NEW INPUT?
00048  A 036c 26   ea    0358         BNE   CRCGEN2   NO, CONTINUE
00049  A 036e b6   ce      A          LDA   RROMBYTE+1 YES
00050  A 0370 a1   07      A          CMPA  #$07      HAVE WE GENED A CRC FOR ENTIRE ROM?
00051  A 0372 26   d6    034a         BNE   GENCRC1   NO, CONTINUE
00052
00053  A 0374 c6   0300    A          LDA   $300      LOAD 1ST BYTE OF CRC VALUE
00054  A 0377 b1   d7      A          CMP   CRC       CMP TO CALCULATED CRC
00055  A 0379 26   07    0382         BNE   CRCGEN4   IF EQUAL CHECK SECOND BYTE
00056  A 037b c6   0301    A          LDA   $301      LOAD 2ND BYTE OF CRC VALUE
00057  A 037e b1   d8      A          CMP   CRC+1     CMP TO CALCULTED 2ND BYTE
00058  A 0380 27   06    0388         BEQ   CRCGEN5   IF EQUAL ROM GOOD
00059
00060  A 0382 a6   05      A CRCGEN4  LDA   #05       LOAD FAILURE CODE
00061  A 0384 bb   e5      A          ADD   TEST      ADD TO RAMTEST CODE
00062  A 0386 b7   e5      A          STA   TEST      SAVE FINAL TEST CODE
00063
00064                         CRCGEN5
00065
00066                                  INCLUDE D:\6805\PASM\2GF\INTERINC.ASM INTERFACE INITIALIZATION
00001                                  OPT   NOL
00014                                  OPT   L
00015
00016
00017  A 0388 3f   c2      A          CLR   LASTIN1   USED IN INPUT MODULE
00018  A 038a 3f   c3      A          CLR   LASTIN2
00019                         *                              AND APPLICATION MODULE
00020  A 038c 3f   ca      A          CLR   SEC60     USED IN INPUT MODULE FOR TIMING
00021  A 038e a6   3b      A          LDA   #SIXTY
00022  A 0390 b7   c9      A          STA   N260      USED IN INPUT MODULE
00023  A 0392 b7   e7      A          STA   060CNTS
00024  A 0394 3f   cb      A          CLR   PULSES    USED IN INPUT MODULE
00025
00026  A 0396 3f   c7      A          CLR   INPUTS    CLEARS THE INPUTS MEMORY LOCATION
00027  A 0398 18   c7      A          BSET  4,INPUTS  SETS THE R/LIMIT INPUT ON
00028  A 039a 3f   c8      A          CLR   OUTPUTS   CLEARS THE OUTPUTS MEMORY LOCATION
00029  A 039c 3f   e2      A          CLR   GOFFREG   USED IN G/ECON ROUTINE
00030  A 039e 3f   e3      A          CLR   IDOFFREG  USED IN W_INDOFT ROUTINE
00031  A 03a0 3f   e8      A          CLR   WONCTR    CLEAR THE DRAFT DELAY ON CTR
00032  A 03a2 3f   e1      A          CLR   MVONREG   USED IN MV ROUTINE
00033  A 03a4 3f   e4      A          CLR   MVOFFREG  USED IN MV ROUTINE
00034  A 03a6 3f   de      A          CLR   FLAGREG1  USED IN ALL ROUTINES
00035  A 03a8 3f   df      A          CLR   FLAGREG2  USED IN ALL ROUTINES
00036  A 03aa 3f   e0      A          CLR   FLAGREG3  USED IN DRAFT ROUTINE
00037  A 03ac 3f   e6      A          CLR   SWICTR    CLEAR THE SWI COUNTER
00038  A 03ae 3f   ea      A          CLR   ONTIMCTR  CLEAR PILOT DRAFT ON TIME CTR
00039  A 03b0 3f   e9      A          CLR   ST_TIMER  CLEAR PILOT DRAFT WAIT CTR
00040  A 03b2 3f   eb      A          CLR   GONCTR    CLEAR G DELAY ON COUNTER
00041  A 03b4 3f   00      A          CLR   PORTA     CLEAR PORTA PRIOR TO TURNING INTO OUTPUTS
00042
00043  A 03b6 5f                      CLRX
00044  A 03b7 cf   07f0    A          STX   WDOG
00045
00046  A 03ba a6   b3      A INITEND  LDA   #$B3
00047  A 03bc b7   db      A          STA   TCSRMASK  INITIALIZE TCSR MASK
00048  A 03be a6   13      A          LDA   #$13
00049  A 03c0 b7   08      A          STA   TCSR      INITIALIZE THE TCSR - TOFE DISABLED, RTIE
00050                         *                              ENABLED, AND RTI RATE 65.5ms
00051  A 03c2 3f   05      A          CLR   DDRB      SET PORT B TO INPUTS
00052  A 03c4 a6   f0      A          LDA   #$F0
00053  A 03c6 b7   04      A          STA   DDRA      SET PORT A TO PA0-3 INPUTS, PA4-7 OUTPUTS
00054  A 03c8 b6   c8      A          LDA   OUTPUTS
00055  A 03ca b7   00      A          STA   PORTA     RESTORE OUTPUT DATA
00056
00057  A 03cc 3f   c1      A          CLR   RTCHIBIT  USED IN CALIBRATION MODULE
00058  A 03ce 3a   e6      A          DEC   SWICTR    DECREMENT SWI COUNTER TO START AT $FF
00059
00060                         *                 INITIALIZE THE FAULT TOLERANCE REGS FOR INPUT ROUTINE
00061
00062  A 03d0 3f   dd      A          CLR   NOISECNT  CLEAR NOISE COUNTER (COUNTS TO #20)
00063  A 03d2 3f   da      A          CLR   IROCNT    CLEAR THE INTERUPT COUNTER
00064  A 03d4 a6   19      A          LDA   #FAULTS   NUMBER OF NON-SAME READINGS PERMITTED
```

BEST AVAILABLE COPY

```
00065  A 03d6 b7   c4       A          STA   NEWCNT   WAITING FOR 55 OF THE IDENTICAL VALUE
00066  A 03d8 a6   08       A          LDA   #CONCNT  NUMBER OF CONSECUTIVE SAME READINGS REQ'D
00067  A 03da b7   c5       A          STA   NEWSAME  BEFORE STARTING A NEW INPUT VALUE
00068
00069  A 03dc a6   34       A          LDA   #52
00070  A 03de b7   dc       A          STA   NUMCHK2
00071  A 03e0 b7   c6       A          STA   NUMCHK   USED IN INPUT MODULE
00072  A 03e2 b7   cc       A          STA   CYCLEFT  USED IN INPUT MODULE
00073
00074  A 03e4 3f   ec       A          CLR   NILOCNT1
00075  A 03e6 3f   ed       A          CLR   NILOCNT2
00076
00077
00078  A 03e8 9c                       RSP            RESET THE STACK POINTER
00067                         *                                                    MODULE
00068
00069                                   INCLUDE D:\6805\PASM\2GF\CALIBC.ASM INTERFACE CALIBRATION
00001                                   OPT   NOL
00016                                   OPT   L
00017
00018  A 03e9 04   0045  0431          BRSET MFGMODE,PORTA,MFGTST IF RTI OCCURS THEN WE ARE MFG TEST
00019
00020  A 03ec 1d   08       A          BCLR  6,TCSR   CLEARS THE RTI FLAG
00021  A 03ee 2e   fe    03ee CALIB    BIL   CALIB
00022  A 03f0 2f   fe    03f0 TRANS    BIH   TRANS    WAITS FOR A HIGH TO LOW TRANSISTION
00023
00024  A 03f2 be   09       A          LDX   TCR      LOAD & STORE REAL TIME CLOCK
00025  A 03f4 bf   c0       A          STX   RTCLOCK  THIS IS THE START TIME
00026  A 03f6 1f   08       A          BCLR  7,TCSR   MAKE SURE TOF BIT IS CLEARED
00027
00028  A 03f8 2f   09    0403 LOW      BIH   HIGH     WAITS FOR A HIGH
00029  A 03fa 0f   08fb  03f8          BRCLR 7,TCSR,LOW WAIT FOR TOF TO GO HIGH
00030  A 03fd 1f   08       A          BCLR  7,TCSR   CLEARS THE TOF BIT AND THEN KEEPS TRACK
00031  A 03ff 3c   c1       A          INC   RTCNIBIT OF THE HIGH BITS
00032  A 0401 20   f5    03f8          BRA   LOW
00033
00034  A 0403 2e   09    040e HIGH     BIL   CALIBRATE WAITS FOR A LOW
00035  A 0405 0f   08fb  0403          BRCLR 7,TCSR,HIGH WAITS FOR TOF TO GO HIGH
00036  A 0408 1f   08       A          BCLR  7,TCSR   CLEARS THE TOF BIT AND THEN KEEPS TRACK
00037  A 040a 3c   c1       A          INC   RTCNIBIT OF THE HIGH BITS
00038  A 040c 20   f5    0403          BRA   HIGH
00039
00040  A 040e b6   09       A CALIBRATE LDA  TCR      LOADS FINISHED TIME LOWER BITS
00041
00042  A 0410 ae   06       A          LDX   #SIX     2^6 = 64 DIVIDE BY 64
00043  A 0412 34   c1       A AGAIN    LSR   RTCNIBIT MOVES NIBITS INTO LOW BITS
00044  A 0414 46                       RORA           WHILE DIVIDING
00045  A 0415 34   c0       A          LSR   RTCLOCK  DIVIDES THE START TIME ALSO
00046  A 0417 5a                       DECX
00047  A 0418 26   f8    0412          BNE   AGAIN
00048  A 041a b0   c0       A          SUB   RTCLOCK  SUBTRACTS THE START TIME FROM THE FINISHED
00049  A 041c a1   10       A          CMP   PULSCLOCK CLOCK VALUE LESS THAN MIN CLOCK ALLOWED
00050  A 041e 25   10    0430          BLO   BADCLOCK IF YES, GO TO SWI
00051  A 0420 a1   90       A          CMP   PULSCLOCK CLOCK VALUE GREATER THAN MAX CLOCK ALLOWED
00052  A 0422 22   0c    0430          BHI   BADCLOCK IF YES, GO TO SWI
00053  A 0424 b7   c0       A          STA   RTCLOCK  THIS IS 1/4 LENGTH OF 60HZ, STORED 4 LATER
00054  A 0426 b7   cb       A          STA   PULSES
00055  A 0428 2e   fe    0428 HOLD1    BIL   HOLD1    WAITS FOR BEGINNING OF NEXT WAVE BECAUSE
00056  A 042a 2f   fe    042a HOLD2    BIH   HOLD2    WHEN LEAVING AN INTERRUPT WILL OCCUR
00057  A 042c 9a                       CLI            AS SO AS THE BIT IS CLEARED
00058  A 042d cc   04ab     A          JMP   START
00059
00060  A 0430 83              BADCLOCK SWI
00061
00062                         ***********************************************************************
00063                         * NOTE : INSTRUCTION SET TO FIND MIDPOINT SHOULD BE 64 INSTRUCTION     *
00064                         *        CYCLES LONG INORDER TO FIND THE MIDPOINT.                     *
00065                         ***********************************************************************
00070                         *                                                                MODULE
00071
00072                                   INCLUDE D:\6805\PASM\2GF\2GFMTSTC.ASM 2GF BOARD TEST MONITOR
00001                                   OPT   NOL
00021                                   OPT   L
00022
00023  A 0431 a6   1e       A MFGTST   LDA   #30      DETERMINE IF AC OR DC
00024  A 0433 b7   ed       A          STA   NILOCNT2
00025                         *         LDA   #$FF
00026                         *         STA   NILOCNT1
00027
00028  A 0435 2f   45    047c MFGTST1  BIH   ACTST
00029  A 0437 3a   ec       A          DEC   NILOCNT1
00030  A 0439 26   fa    0435          BNE   MFGTST1
00031  A 043b 3a   ed       A          DEC   NILOCNT2
```

BEST AVAILABLE COPY

```
A 043d 26  f6    0435          BNE   NFGTST1
A 043f 1d  08      A           BCLR  6,TCSR    CLEAR RTIF
A 0441 10  00      A TSTYES    BSET  0,PORTA   TURN ON INDUCED DRAFT RELAY
A 0443 0a  01fd  0443 GTST1    BRSET 5,PORTB,GTST1 WAIT FOR G=0
                       *        CLRX
                       *        STX   WDOG              PET THE WATCH DOG
A 0446 3f  c6      A           CLR   NUMCHK
A 0448 3f  01      A           CLR   PORTB     TURN ALL OFF BEFORE SETTING INS TO OUTS
A 044a a6  1c      A           LDA   #$1C      SET UP R,W,MV AS OUTPUTS
A 044c b7  05      A           STA   DDRB
A 044e d6  06de    A XFER      LDA   PHREV,X   MOVE DATA INTO ACCUMULATOR USING X REGISTER
                       *                                AS INDEX TO TABLE OF DATA
A 0451 ad  3c    048f          BSR   SERIAL    SEND ACCUMULATOR TO TEST STATION

A 0453 5f                      CLRX
A 0454 cf  07f0    A           STX   WDOG

A 0457 3c  c6      A           INC   NUMCHK    INCREMENT NUMBER OF BYTES TRANSFERRED
A 0459 be  c6      A           LDX   NUMCHK
A 045b c3  06de    A           CPX   PHREV     COMPARE NUMBER OF BYTES XFER'D TO FIRST
                       *                                TABLE ENTRY (WHICH IS THE COUNT)
A 045e 26  ee    044e          BNE   XFER      ALL DONE; NO, CONTINUE XFER
A 0460 b6  e5      A           LDA   TEST      LOAD RESULTS OF SELF TEST INTO ACC
A 0462 ad  2b    048f          BSR   SERIAL    SEND ACC TO TEST STATION
                       *        CLRX
                       *        STX   WDOG              PET THE WATCH DOG
A 0464 3f  c6      A           CLR   NUMCHK
A 0466 b6  e5      A           LDA   TEST      RE-LOAD SELF TEST RESULTS FOR CHECK SUM
A 0468 fb  06de    A CSUM      ADD   PHREV,X   ACCUMULATE SUM IN ACC; INDEXED BY X
A 046b 5c                      INCX            INDEXED DATA POINTER
A 046c c3  06de    A           CPX   PHREV     COMPARE COUNT TO FIRST DATA ENTRY IN TABLE
A 046f 26  f7    0468          BNE   CSUM      ALL DONE; NO, CONTINUE TO ACCUMULATE
A 0471 ad  1c    048f          BSR   SERIAL    SEND ACC (CHECK SUM) TO TEST STATION

A 0473 0a  01fd  0473 GTST2    BRSET 5,PORTB,GTST2 WAIT FOR G=0
A 0476 3f  01      A           CLR   PORTB     TURN ALL PORT B OUTS OFF
A 0478 3f  05      A           CLR   DDRB      SET ALL PORTB TO INPUTS
A 047a 3f  00      A           CLR   PORTA     TURN INDUCED DRAFT OFF
A 047c a6  01      A ACTST     LDA   #1        SET UP NEW TIME DELAYS
A 047e b7  c6      A           STA   NUMCHK    STORE NEW NUMBER OF INPUTS
A 0480 b7  dc      A           STA   NUMCHK2
A 0482 b7  c9      A           STA   NZ60      STORE NEW CLOCK RATE
A 0484 a6  b0      A           LDA   #$B0
                       *        CLRX
                       *        STX   WDOG              PET THE WATCH DOG (X CLEARED ABOVE)
A 0486 b7  db      A           STA   TCSRMASK
A 0488 1d  08      A           BCLR  6,TCSR
A 048a 3f  cb      A           CLR   PULSES
A 048c cc  03ee    A           JMP   CALIB     RETURN TO NORMAL OPERATION WITH ALL
                       *                                TIMEOUTS DIVIDED BY 60

                       ***********************************************************************
                       *                                                                     *
                       *  THIS SUBROUTINE TRANSFERS DATA TO THE MFG TEST EQUIPMENT.          *
                       *                    1) CONTENTS OF INDEX REGISTER MODIFIED           *
                       *                    2) ACCUMULATOR CONTAINS THE BYTE TO BE TRANSFERED *
                       *                    3) BIT 4 OF PORT B IS THE MSB OF THE TWO BITS XFER'D *
                       *                    4) BIT 3 OF PORT B IS THE LSB OF THE TWO BITS XFER'D *
                       *                    5) BIT 5 OF PORT B = 0 INDICATES TEST STATION READY *
                       *                       FOR MORE DATA                                 *
                       *                    6) BIT 5 OF PORT B = 1 INDICATES THE TEST STATION HAS *
                       *                       READ LAST DATA                                *
                       *                    7) BIT 2 OF PORT B IS SET WHEN NEW DATA IS AVAILABLE *
                       *                       TO TEST STATION                               *
                       *                    8) BIT 2 OF PORT B IS CLEARED WHEN DATA IS BEING  *
                       *                       ALTERED                                       *
                       ***********************************************************************

A 048f ae  04      A SERIAL    LDX   #4        SET # OF 2 BIT XFERS
A 0491 15  01      A           BCLR  2,PORTB   CLEAR BIT 2 OF PORTB: DATA CHANGING (MV)
A 0493 0a  01fd  0493 GWAIT1   BRSET 5,PORTB,GWAIT1 WAIT FOR G=0
A 0496 49                      ROLA            CHECK FIRST BIT
A 0497 24  02    049b          BCC   BIT1      FIRST BIT = 0
A 0499 18  01      A           BSET  4,PORTB   NO, SET BIT 4 OF PORTB (R/LIMIT)
A 049b 49              BIT1    ROLA            CHECK SECOND BIT
A 049c 24  02    04a0          BCC   BIT2      SECOND BIT = 0
A 049e 16  01      A           BSET  3,PORTB   NO, SET BIT 3 OF PORTB (W)
A 04a0 14  01      A BIT2      BSET  2,PORTB   SET BIT 2 OF PORTB : SIGNALS TEST STATION
                       *                                NEW DATA AVAILABLE
A 04a2 0b  01fd  04a2 GWAIT2   BRCLR 5,PORTB,GWAIT2 WAIT FOR G=1
A 04a5 3f  01      A           CLR   PORTB     CLEAR PORT B OUTPUTS: DATA CHANGING
A 04a7 5a                      DECX            DECREMENT NUMBER OF 2 BIT XFERS
A 04a8 26  e9    0493          BNE   GWAIT1    ALL 8 BITS XFER'D; NO, SEND MORE
```

BEST AVAILABLE COPY

```
A 04ae 81                          RTS            ALL DONE: RETURN

                                   INCLUDE D:\6805\PASM\2GF\2GFRC.ASM 2GF PROGRAM MODULE
                                   OPT   NOL
                                   OPT   L

A 04ab 1f   ca       A START       BCLR  7,SEC60  CLEAR 60 HERTZ PRESENT FLAG
A 04ad 1d   ca       A             BCLR  6,SEC60  CLEAR RT OPERATION FLAG

A 04af 0f   cafd  04af STARTX      BRCLR 7,SEC60,STARTX WAIT FOR 60 HERTZ PRESENT FLAG
A 04b2 0d   cafa  04af             BRCLR 6,SEC60,STARTX WAIT FOR RT OPERATION FLAG

A 04b5 5f                          CLRX
A 04b6 cf   07f0     A             STX   WDOG     RESET THE WATCH DOG TIMER
A 04b9 bf   da       A             STX   IRQCNT   CLEAR THE INTERUPT COUNTER


                          ****************************************
                          *   R/LIMIT ROUTINE                    *
                          ****************************************

A 04bb 09   c706  04c4             BRCLR 4,INPUTS,R_OFF IS R ON?
A 04be 1e   de       A             BSET  7,FLAGREG1 IF ON, SET RFLAG=1
A 04c0 1f   c8       A             BCLR  7,OUTPUTS TURN ON LED IF LIMIT IS CLOSED
A 04c2 20   07    04cb             BRA   G_ECON
A 04c4 1f   de       A R_OFF       BCLR  7,FLAGREG1 IF OFF, SET RFLAG=0
A 04c6 1e   c8       A             BSET  7,OUTPUTS TURN ON LED IF LIMIT IS OPEN
A 04c8 cd   064b     A             JSR   CLRDRFT



                          ****************************************
                          *   G/ECON  ROUTINE                    *
                          ****************************************

A 04cb 0b   c716  04e4 G_ECON      BRCLR 5,INPUTS,G_OFF IS G_ECON ON?
A 04ce 0a   e008  04d9             BRSET [illegible],FLAGREG3,GDLYON
A 04d1 1a   e0       A             BSET [illegible],FLAGREG3
A 04d3 a6   04       A             LDA [illegible]
A 04d5 b7   ab       A             STA [illegible]
A 04d7 20   20    04f9             BRA   W_INDDFT

A 04d9 0c   da1d  04f9 GDLYON      BRSET [illegible],FLAGREG1,W_INDDFT DELAY ON ROUTINE
A 04dc 3d   db       A             TST [illegible]
A 04de 26   19    04f9             BNE [illegible]
A 04e0 1c   de       A             BSET [illegible],FLAGREG1
A 04e2 20   15    04f9             BRA   W_INDDFT

A 04e4 0b   e00a  04f1 G_OFF       BRCLR [illegible],FLAGREG3,G_CTR IF GFLAG1=0 GO CHECK COUNTER
A 04e7 1a   de       A             BSET [illegible] SET GFLAG2=1
A 04e9 1b   e0       A             BCLR [illegible],FLAGREG3 SET GONFLAG=0
A 04eb a6   3c       A             LDA   [illegible]
A 04ed b7   e2       A             STA   [illegible]  LOAD G_OFF COUNTER
A 04ef 20   08    04f9             BRA   W_INDDFT

A 04f1 3d   e2       A G_CTR       TST   [illegible] TEST COUNTER FOR ZERO COUNT
A 04f3 26   04    04f9             BNE   W_INDDFT IF NOT ZERO, BRANCH TO NEXT ROUTINE
A 04f5 1b   de       A             BCLR  5,[illegible] SET GFLAG2=0
A 04f7 1d   de       A             BCLR  GFLAG1,FLAGREG1

                          ****************************************
                          *   W_INDDFT ROUTINE                   *
                          ****************************************

A 04f9 07   c71b  0517 W_INDDFT BRCLR 3,INPUTS,W_OFF IS W_INDDFT ON?

A 04fc 00   e008  0507             BRSET WONFLAG,FLAGREG3,W_DLYON HAS THE W FLAG ALREADY BEEN SET?

A 04ff 10   e0       A             BSET  WONFLAG,FLAGREG3 SET FLAG FOR W ON STATE
A 0501 a6   04       A             LDA   #IDLYON  INITIALIZE DELAY ON TIMER
A 0503 b7   e8       A             STA   WONCTR
A 0505 20   33    053a             BRA   W_END

A 0507 02   e058  0562 W_DLYON     BRSET WOFFLAG1,FLAGREG3,MV BRANCH TO END IF DELAY ON IS COMPLETE
A 050a 3d   e8       A             TST   WONCTR   HAS THE DELAYON COUNTER TIMED OUT?
A 050c 26   2c    053a             BNE   W_END

A 050e 12   e0       A             BSET  WOFFLAG1,FLAGREG3

A 0510 cd   064b     A             JSR   CLRDRFT
A 0513 3f   e9       A             CLR   ST_TIMER
A 0515 20   23    053a             BRA   W_END
```

BEST AVAILABLE COPY

```
A 0517 01   e013  052d W_OFF     BRCLR WONFLAG,FLAGREG3,W_DLYOFF IF FLAG IS NOT SET GO TO DLYOFF
A 051a 03   e00a  0527           BRCLR WOFFLAG1,FLAGREG3,SHORT_W

A 051d a6   1c      A            LDA   #IDLYOFF INITIATE ID DELAY OFF TIMER
A 051f b7   e3      A            STA   IDOFFREG
A 0521 14   e0      A            BSET  WOFFLAG2,FLAGREG3 SET STATE FLAGE FOR W OFF AND
A 0523 11   e0      A            BCLR  WONFLAG,FLAGREG3 DLEAY TIME OFF
A 0525 20   13    053a           BRA   W_END

A 0527 3f   e8      A SHORT_W    CLR   WONCTR   CLEAR DELAY ON COUNTER
A 0529 11   e0      A            BCLR  WONFLAG,FLAGREG3 CLEAER THE W ON FLAG
A 052b 20   0d    053a           BRA   W_END

A 052d 06   0002  0532 W_DLYOFF  BRSET MODEIDLY,PORTA,CTR_OFF IS THE DELAY OFF BYPASSED?
A 0530 3f   e3      A            CLR   IDOFFREG RESET THE DELAY OFF COUNTER

A 0532 3d   e3      A CTR_OFF    TST   IDOFFREG IS THE DELAY OFF COUNTER=0?
A 0534 26   04    053a           BNE   W_END

A 0536 13   e0      A            BCLR  WOFFLAG1,FLAGREG3
A 0538 15   e0      A            BCLR  WOFFLAG2,FLAGREG3

                          ****************************************
                          *   TIMED PILOT DRAFT OPTION ROUNTINE     *
                          *                                         *
                          ****************************************

A 053a 02   0025  0562 W_END     BRSET PILOTDFT,PORTA,MV IS THE OPTION TAB REMOVED??
A 053d 02   e022  0562           BRSET WOFFLAG1,FLAGREG3,MV BYPASS ROUTINE IF DRAFT IS
                          *                                        ALREADY ON

A 0540 06   e008  054b           BRSET STRTIMER,FLAGREG3,WAIT_ON HAS THE WAIT PERIOD STARTED?

A 0543 a6   3c      A            LDA   #WAITIME INITIALIZE THE WAIT PERIOD TIMER
A 0545 b7   e9      A            STA   ST_TIMER AND SET THE MODE FLAG
A 0547 16   e0      A            BSET  STRTIMER,FLAGREG3
A 0549 20   17    0562           BRA   MV

A 054b 3d   e9      A WAIT_ON    TST   ST_TIMER TIME UP YET??
A 054d 26   13    0562           BNE   MV

A 054f 08   e008  055a           BRSET ONFLAG,FLAGREG3,ITS_ON HAS THE DRAFT ON MODE STARTED?

A 0552 18   e0      A            BSET  ONFLAG,FLAGREG3 INITIATE DRAFT ON MODE
A 0554 a6   78      A            LDA   #ONTIME
A 0556 b7   ea      A            STA   ONTIMCTR
A 0558 20   08    0562           BRA   MV

A 055a 3d   ea      A ITS_ON     TST   ONTIMCTR
A 055c 26   04    0562           BNE   MV

A 055e 19   e0      A            BCLR  ONFLAG,FLAGREG3
A 0560 17   e0      A            BCLR  STRTIMER,FLAGREG3

                          ****************************************
                          *   MV       ROUTINE                  *
                          ****************************************

A 0562 05   c719  057e MV        BRCLR 2,INPUTS,MV_OFF IF MV=0,BRANCH TO MV_OFF

A 0565 cd   064b    A            JSR   CLRDRFT

A 0568 00   de08  0573           BRSET 0,FLAGREG1,MVDLYON IF MVONFLAG=1 BRANCH TO MVDLYON
A 056b 10   de      A            BSET  0,FLAGREG1 SET MVONFLAG=1
A 056d a6   1e      A            LDA   #MVONDLY
A 056f b7   e1      A            STA   MVONREG  INITIATE MVONDLY TIMER
A 0571 20   20    0593           BRA   OUTPUT

A 0573 04   de1d  0593 MVDLYON   BRSET 2,FLAGREG1,OUTPUT IF MVOFFLAG1=1 BRANCH TO OUTPUT
A 0576 3d   e1      A            TST   MVONCTR MVONCTR=0?
A 0578 26   19    0593           BNE   OUTPUT   MVONCTR NOT =0,THEN BRANCH TO OUTPUT
A 057a 14   de      A            BSET  2,FLAGREG1 SET MVOFFLAG1=1
A 057c 20   15    0593           BRA   OUTPUT

A 057e 01   de0a  058b MV_OFF    BRCLR 0,FLAGREG1,MVDLYOFF IF MVONFLAG=0,BRANCH TO MVDLYOFF
A 0581 12   de      A            BSET  1,FLAGREG1 SET MVOFFLAG2=1
A 0583 11   de      A            BCLR  0,FLAGREG1 SET MVONDLY=0
A 0585 a6   b4      A            LDA   #MVOFFDLY
A 0587 b7   e4      A            STA   MVOFFREG INITIATE MVOFFDLY COUNTER
A 0589 20   08    0593           BRA   OUTPUT
```

BEST AVAILABLE COPY

```
00176
00177  A 058b 3d   e4      A MVDLYOFF TST   MVOFFREG IF MVOFFDLY COUNTER NOT = 0
00178  A 058d 26   04   0593          BNE   OUTPUT   BRANCH TO OUTBUF
00179  A 058f 13   de      A          BCLR  1,FLAGREG1 MVOFFLAG2=0
00180  A 0591 15   de      A          BCLR  2,FLAGREG1 MVOFFLAG1=0
00181
00182                          ****************************************
00183                          *      OUTPUT FLAG ROUTINE             *
00184                          ****************************************
00185
00186  A 0593 b6   de      A OUTPUT   LDA   FLAGREG1
00187  A 0595 a4   60      A          AND   #COOLMASK
00188  A 0597 27   06   059f          BEQ   CLOFFLAG IF GFLAG1=0 AND GFLAG2=0
00189                          *                              THEN BRANCH TO CLOFFLAG
00190  A 0599 14   df      A          BSET  2,FLAGREG2 HT_CLFLAG=1, COOL FAN ON
00191  A 059b 17   df      A          BCLR  3,FLAGREG2 CL_HTFLAG=0, HEAT FAN OFF
00192  A 059d 20   14   05b3          BRA   OUTBUF
00193
00194  A 059f 15   df      A CLOFFLAG BCLR  2,FLAGREG2 HT_CLFLAG=0, COOL FAN OFF
00195
00196  A 05a1 b6   de      A          LDA   FLAGREG1
00197  A 05a3 a4   87      A          AND   #HEATMASK
00198
00199  A 05a5 a1   81      A          CMP   #HEAT1   IF FLAGREG1=1XXX X001
00200  A 05a7 27   08   05b1          BEQ   HTOFFLAG THEN TURN HEAT OFF
00201
00202  A 05a9 a1   80      A          CMP   #HEAT2   IF FLAGREG1=1XXX X000
00203  A 05ab 27   04   05b1          BEQ   HTOFFLAG THEN TURN HEAT OFF
00204
00205  A 05ad 16   df      A          BSET  3,FLAGREG2 CL_HTFLAG=1, HEAT FAN ON
00206  A 05af 20   02   05b3          BRA   OUTBUF   TURN HEAT ON
00207
00208  A 05b1 17   df      A HTOFFLAG BCLR  3,FLAGREG2 CL_HTFLAG=0, HEAT FAN OFF
00209
00210                          ****************************************
00211                          *      OUTPUT BUFFER ROUTINE           *
00212                          ****************************************
00213                          *
00214                          *  THIS ROUTINE ONLY RUNS ONCE EVERY SECOND
00215                          *  IT IS BASED ON THE ONE SECOND CLOCK BIT THAT IS TOGGLED
00216                          *  IN THE "jbb" ROUTINE
00217                          *
00218
00219  A 05b3 01   ca7e  0634 OUTBUF   BRCLR 0,SEC60,IND_DFT IF SECOND FLAG IS NOT SET
00220                          *                              BRANCH TO END OF TIMER ROUTINE
00221  A 05b6 11   ca      A          BCLR  0,SEC60  CLEAR SECONDS FLAG
00222
00223  A 05b8 05   df0f  05ca         BRCLR 2,FLAGREG2,HEAT IF HT_CLFLAG=0, BRANCH TO HEAT
00224  A 05bb 01   df06  05c4         BRCLR 0,FLAGREG2,HEATOFF IF TIMEOUT1=0, BRANCH TO HEATOFF
00225
00226  A 05be 1c   c8      A          BSET  6,OUTPUTS *** TURN COOL FAN ON ****
00227
00228  A 05c0 13   df      A          BCLR  1,FLAGREG2 TIMEOUT2=0
00229  A 05c2 20   24   05e8          BRA   TIMERS
00230
00231  A 05c4 19   c8      A HEATOFF  BCLR  4,OUTPUTS *** TURN HEAT FAN OFF ***
00232
00233  A 05c6 10   df      A          BSET  0,FLAGREG2 TIMEOUT1=1
00234  A 05c8 20   1e   05e8          BRA   TIMERS
00235
00236  A 05ca 07   df0f  05dc HEAT    BRCLR 3,FLAGREG2,ALLOFF IF CL_HTFLAG=0, BRANCH TO ALLOFF
00237  A 05cd 03   df06  05d6         BRCLR 1,FLAGREG2,COOLOFF IF TIMEOUT2=0, BRANCH TO COOLOFF
00238
00239
00240  A 05d0 18   c8      A          BSET  4,OUTPUTS *** TURN HEAT FAN OFF ***
00241
00242  A 05d2 11   df      A          BCLR  0,FLAGREG2 TIMEOUT1=0
00243  A 05d4 20   12   05e8          BRA   TIMERS
00244
00245  A 05d6 1d   c8      A COOLOFF  BCLR  6,OUTPUTS *** TURN COOL FAN OFF ***
00246
00247  A 05d8 12   df      A          BSET  1,FLAGREG2 TIMEOUT2=1
00248  A 05da 20   0c   05e8          BRA   TIMERS
00249
00250  A 05dc 19   c8      A ALLOFF   BCLR  4,OUTPUTS *** TURN OFF HEAT FAN ***
00251  A 05de 1d   c8      A          BCLR  6,OUTPUTS *** TURN OFF COOL FAN ***
00252
00253  A 05e0 3d   e6      A          TST   SWICTR   TEST THE SWI COUNTER FOR ZERO
00254  A 05e2 26   04   05e8          BNE   TIMERS   IF NOT ZERO, BRANCH TO TIMERS
00255  A 05e4 0e   c801  05e8         BRSET 5,OUTPUTS,TIMERS IF IND DFT IS ON, BRANCH TO TIMERS
00256  A 05e7 83                      SWI            IF ALL FANS ARE OFF, AND THE SWICTR
00257                          *                              EQUALS ZERO, THEN RESET/CALIBRATE
00258
```

```
                          ****************************************
                          *      TIMERS          ROUTINE         *
                          ****************************************

A 05e8 01   de0c  05f7 TIMERS   BRCLR WONFLAG,FLAGREG1,G_DLYON
A 05eb 00   e009  05f7          BRSET WOFFLAG,FLAGREG1,G_DLYON
A 05ee 0e   e804  05f5          BRSET LED,OUTPUTS,LEDOFF
A 05f1 1e   e8      A           BSET  LED,OUTPUTS
A 05f3 20   02    05f7          BRA   G_DLYON

A 05f5 1f   e8      A LEDOFF    BCLR  LED,OUTPUTS


A 05f7 0b   e005  05ff G_DLYON  BRCLR WONFLAG,FLAGREG3,G_DLYOFF
A 05fa 0c   de02  05ff          BRSET GFLAG1,FLAGREG1,G_DLYOFF
A 05fd 3a   eb      A           DEC   GONCTR

A 05ff 0b   de02  0604 G_DLYOFF BRCLR 5,FLAGREG1,ID_DLY DEC G DELAY REG IF GFLAG2=1
A 0602 3a   e2      A           DEC   GOFFREG

A 0604 01   e005  060c ID_DLY   BRCLR WONFLAG,FLAGREG3,WODLYOFF HAS THE W FLAG BEEN SET?
A 0607 02   e002  060c          BRSET WOFFLAG1,FLAGREG3,WODLYOFF IS THE DRAFT FAN ON FLAG SET?

A 060a 3a   e8      A           DEC   WONCTR

A 060c 05   e002  0611 WODLYOFF BRCLR WOFFLAG2,FLAGREG3,PILOT_DLY
A 060f 3a   e3      A           DEC   IDOFFREG

A 0611 07   e011  0625 PILOT_DLY BRCLR STRTIMER,FLAGREG3,MV_DLYON IS THE SYSTEM IN WAIT MODE?
A 0614 08   e00c  0623          BRSET ONFLAG,FLAGREG3,PILOT_ON IS THE DRAFT ON CYCLE ACTIVE?

A 0617 3a   e7      A           DEC   060CNTS
A 0619 26   0a    0625          BNE   MV_DLYON

A 061b 3a   e9      A           DEC   ST_TIMER DECREMENT DRAFT OFF TIMER ONCE A MINUTE
A 061d a6   3c      A           LDA   #60
A 061f b7   e7      A           STA   060CNTS
A 0621 20   02    0625          BRA   MV_DLYON

A 0623 3a   ea      A PILOT_ON DEC    ONTIMCTR

A 0625 01   de05  062d MV_DLYON BRCLR 0,FLAGREG1,MV_DLYOFF
A 0628 04   de02  062d          BRSET 2,FLAGREG1,MV_DLYOFF
A 062b 3a   e1      A           DEC   MVONREG  DEC MVONDLY IF MVONFLAG=1 AND
                                *                            MVOFFLAG1=0

A 062d 03   de02  0632 MV_DLYOFF BRCLR 1,FLAGREG1,SWINT
A 0630 3a   e4      A           DEC   MVOFFREG DEC MVOFFDLY IF MVOFFLAG2=1

A 0632 3a   e6      A SWINT     DEC   SWICTR   DEC THE SWI COUNTER EVERY SECOND


                          ****************************************
                          *   INDUCED DRAFT ON/OFF ROUTINE       *
                          ****************************************

A 0634 b6   de      A IND_DFT   LDA   FLAGREG1
A 0636 a4   81      A           AND   #IDOFFMASK1 MASK FLAGREG1 %1000 0001
A 0638 a1   80      A           CMP   #IDOFFMASK1 DOES FLAGREG1=%1000 0000
A 063a 26   06    0642          BNE   ID_ON    IF YES, TURN OFF ID FAN

A 063c b6   e0      A           LDA   FLAGREG3 MASK FLAGREG3 %0001 0010
A 063e a4   12      A           AND   #MASK2
A 0640 27   04    0646          BEQ   ID_OFF


A 0642 1a   c8      A ID_ON     BSET  5,OUTPUTS *** IF NO, TURN ID FAN ON **

A 0644 20   02    0648          BRA   ID_END

A 0646 1b   c8      A ID_OFF    BCLR  5,OUTPUTS *** TURN ID FAN OFF ***

A 0648 cc   04ab    A ID_END    JMP   START

                          ************************************************************
                          *
                          *   SUBROUTINE TO CLEAR DRAFT WAIT TIME
                          *
                          ************************************************************

A 064b 17   e0      A CLRDRFT   BCLR  STRTIMER,FLAGREG3
A 064d 19   e0      A           BCLR  ONFLAG,FLAGREG3
A 064f 3f   ea      A           CLR   ONTIMCTR
A 0651 3f   e9      A           CLR   ST_TIMER
```

BEST AVAILABLE COPY

```
00343  A 0653 a6  3c        A          LDA   #60
00344  A 0655 b7  e7        A          STA   060CNTS
00345  A 0657 81                       RTS
00346
00347
00075
00076                                  INCLUDE D:\6805\PASM\2GF\INPUTC.ASM INTERFACE INPUT MODULE
00001                                  OPT   NOL
00015                                  OPT   L
00016
00017  A 0658 1e  ca        A IROV     BSET  7,SEC60  SET 60 HERTZ PRESENT FLAG
00018
00019  A 065a b6  da        A          LDA   IROCNT   THIS LIMITS THE NUMBER OF INTERRUPTS THAT
00020  A 065c 4c                       INCA           CAN BE COUNTED WITHOUT THE CONTROL PROGRAM
00021  A 065d a1  14        A          CMP   #20      BEING EXECUTED
00022  A 065f 24  67     06c8          BHS   RET
00023
00024  A 0661 b7  da        A          STA   IROCNT
00025  A 0663 b6  c0        A          LDA   RTCLOCK  LOAD THE RTCLOCK VALUE
00026
00027  A 0665 ae  09        A LOOP1    LDX   #9       2 CYC DELAY
00028  A 0667 9d                       NOP            2 CYC DELAY
00029  A 0668 5a                 LOOP  DECX           3 CYC DELAY
00030  A 0669 26  fd     0668          BNE   LOOP     3 CYC DELAY
00031  A 066b 4a                       DECA           3 CYC DELAY
00032  A 066c 26  f7     0665          BNE   LOOP1    3 CYC DELAY: ONE COMPLETE LOOP=64 CYC
00033
00034
00035  A 066e b6  01        A          LDA   PORTB    WE ARE NOW AT MID POINT READ INPUTS
00036
00037
00038  A 0670 02  010d     0680        BRSET 1,PORTB,FAULT IF C INPUT IS HIGH THEN INPUT MUST BE OUT
00039                                *                          OF SYNCH, GO TO FAULT COUNT
00040
00041  A 0673 05  0016     068c        BRCLR 2,PORTA,NORMOP CONTINUE WITH NORMAL OPERATION IF MFG TEST
00042                                *                          INPUT REMAINS LOW
00043
00044
00045  A 0676 b7  c7        A          STA   INPUTS   IN ACCEL. TEST MODE, ALWAYS UPDATE INPUTS
00046
00047  A 0678 a6  13        A          LDA   #19      SWI generated if out of synch one time
00048  A 067a b7  dd        A          STA   NOISECNT
00049
00050  A 067c 1c  ca        A          BSET  6,SEC60
00051  A 067e 20  46     06c6          BRA   FAST
00052
00053
00054  A 0680 b6  dd        A FAULT    LDA   NOISECNT ALLOW 20 NOISE INTERUPTS BEFORE RESETING
00055  A 0682 4c                       INCA           DO NOT CHANGE INPUT COUNTERS
00056  A 0683 a1  14        A          CMP   #20
00057  A 0685 24  04     068b          BHS   STRTOVR  IF NOISECNT=20 GO TO SWI
00058  A 0687 b7  dd        A          STA   NOISECNT
00059  A 0689 20  3d     06c8          BRA   RET
00060
00061  A 068b 83                 STRTOVR SWI
00062
00063                                *
00064  A 068c b1  c2        A NORMOP   CMP   LASTIN1  CHECK IF THEY ARE THE SAME AS LAST LOAD
00065  A 068e 26  08     0698          BNE   NEWIN1   IF YES, HAS THERE BEEN 60 READS
00066
00067  A 0690 3a  cc        A          DEC   CYCLEFT  CHECKS FOR 60 INPUTS CONSECUTIVELY
00068  A 0692 26  28     06bc          BNE   SECONDS  IF 60 READS HAVEN'T OCCURED GO UPDATE CLOCK
00069
00070  A 0694 b7  c7        A          STA   INPUTS   IF 60 READS HAVE OCCURED UPDATE INPUTS MEM.
00071  A 0696 20  18     06b0          BRA   RESET1
00072
00073  A 0698 3a  c4        A NEWIN1   DEC   NEWCNT
00074  A 069a 27  14     06b0          BEQ   RESET1
00075
00076  A 069c b1  c3        A          CMP   LASTIN2  START OVER LOOKING FOR 60 READS CONSEC.
00077  A 069e 26  0c     06ac          BNE   NEWIN2
00078
00079  A 06a0 3a  c5        A          DEC   NEWSAME
00080  A 06a2 26  18     06bc          BNE   SECONDS
00081
00082  A 06a4 b7  c2        A          STA   LASTIN1
00083  A 06a6 b6  dc        A          LDA   NEWCNT2
00084  A 06a8 b7  cc        A          STA   CYCLEFT
00085  A 06aa 20  08     06b4          BRA   RESET2
00086
00087  A 06ac b7  c3        A NEWIN2   STA   LASTIN2
00088  A 06ae 20  08     06b8          BRA   LOWSAME
00089
```

```
A 06b0 b6  c6      A RESET1  LDA   NUMCHK   NUMCHK+1 NUMBER OF CONSECUTIVE READS DESIRED
A 06b2 b7  cc      A         STA   CYCLEFT  NUMBER OF READ LEFT BEFORE CONSIDERED O.K.

A 06b4 a6  19      A RESET2  LDA   #FAULTS  REINITIALIZE ALL CNTS
A 06b6 b7  c4      A         STA   REVCNT
A 06b8 a6  08      A LDNWSAME LDA  #CODECNT INITIALIZE THE # OF READS REQ'D TO UPDATE
                     *                          LAST INPUT REG.
A 06ba b7  c5      A         STA   NEWSAME

A 06bc 3c  cb      A SECONDS INC   PULSES   NZ60 KEEPS TRACK OF 1 SECOND TIME
A 06be b6  c9      A         LDA   NZ60     60 CYCLES IS 1 SECOND
A 06c0 b1  cb      A         CMP   PULSES   HAS 1 SECOND ELASPED
A 06c2 26  04    06c8        BNE   RET      IF NOT EQUAL THEN GET OUT OF ROUTINE

A 06c4 3f  cb      A         CLR   PULSES
A 06c6 10  ca      A FAST    BSET  0,SEC60  IF EQUAL THEN SET BIT TO SHOW ONE SEC.

A 06c8 80            RET     RTI

                             INCLUDE D:\6805\PASM\2GF\OUTPUT.ASM INTERFACE OUTPUT MODULE
                             OPT   NOL
                             OPT   L

A 06c9 b6  c8      A TIMERV  LDA   OUTPUTS  LOAD THE OUTPUTS TO SET
A 06cb b7  00      A         STA   PORTA
A 06cd a6  13      A         LDA   #$13     TCSRMASK          LOAD THE TCSR
                     *        AND   TCSR                 RESET RTIF
A 06cf b7  08      A         STA   TCSR
A 06d1 1c  ca      A         BSET  6,SEC60  SET REAL TIME CLOCK OPERATING PROPERLY
A 06d3 80                    RTI            RETURN FROM THE INTERRUPT

                             INCLUDE D:\6805\PASM\2GF\RROMBYTE.ASM CRC ROM IMAGE
                             OPT   NOL
                             OPT   L

                       ***********************************
                       *     RROMBYTE  SUBROUTINE        *
                       ***********************************
                       * ROM IMAGE OF RAM ROUTINE

A 06d4 c6  0302    A RMIMAGE LDA   $302
A 06d7 3c  cf      A         INC   RROMBYTE+2
A 06d9 26  02    06dd        BNE   RMIMAGE1
A 06db 3c  ce      A         INC   RROMBYTE+1
A 06dd 81            RMIMAGE1 RTS

                             INCLUDE D:\6805\PASM\2GF\2GFPNCP0.ASM 2GF PART NUMBER AND
                             OPT   NOL
                             OPT   L

A 06de     07      A PNREV   FCB   $07      NUMBER OF DIGITS IN PN AND REV
A 06df     35      A         FCC   5,59270            PART NUMBER
A 06e4     41      A         FCC   1,A                REVISION LEVEL

A 06e5     40      A         FCC   6,@TEXAS           COPYRIGHT NOTICE
A 06eb     20      A         FCC   12, INSTRUMENTS        "       "
A 06f7     30      A         FCC   8,09-19-91         COPYRIGHT DATE
                     *                                                  COPYRIGHT MODULE

A 06ff     01      A         DCB   ROMEND-*+1,$83 FILL REMAINING ROM
                     *                                                  LOCATIONS WITH SWI's

                       ***************************************************************************
                       *     PART NUMBER, COPYRIGHT, MOR (OPTIONAL), AND VECTORS SETUP SECTION     *
                       ***************************************************************************

                       *        INCLUDE D:\6805\PASM\2GF\J2MOR.ASM

A 07f8                           ORG   J1VCTRS

                                 INCLUDE D:\6805\PASM\2GF\J1VCTRS.ASM J1 TIMER, IRQ, SWI, AND
                                 OPT   NOL
                                 OPT   L

A 07f8     06c9    A             FDB   TIMERV   TIMER VECTOR
A 07fa     0658    A             FDB   IRQV     INTERRUPT REQUEST VECTOR
A 07fc     0302    A             FDB   RESETV   SOFTWARE INTERRUPT VECTOR
A 07fe     0302    A             FDB   RESETV   RESET INTERRUPT VECTOR
                     *                                                  RESET VECTORS MODULE

                                 END
```

BEST AVAILABLE COPY

```
Total number of errors: 0
Total number of warnings: 0
Total number of lines: 1228


Number of bytes in section ASCT: 1080

Number of bytes in program: 1080

            CROSS REFERENCE TABLE
NAME     ATTRB S VALUE P:LINE LINE1....N

ACTST          A 047c 10:71        28
AGAIN          A 0412  9:43        47
ALLOFF         A 05dc 16:250      236
BADCLOCK       A 0430  9:60        50   52
BIT1           A 049b 11:107      105
BIT2           A 04a0 11:110      108
BITCNT         A 00d9  4:31        33   47
CALIB          A 00ee  9:21        21   81
CALIBRAT       A 040e  9:40        34
CLOFFLAG       A 059f 15:194      188
CLOKRFT        A 064b 18:339       39   91  156
COMPARE        A 031b  6:37        34
CONCNT    EQU  A 0008  2:22        66   95
COOLMASK  EQU  A 0060  3:24       187
COOLOFF        A 05d6 16:245      237
CRC            A 00d7  4:30        27   28   30   31   37   38   41   42   44   45   54   57
CRCGEN2        A 0358  7:37        48
CRCGEN3        A 036a  7:47        39
CRCGEN4        A 0382  7:60        55
CRCGEN5        A 0388  7:64        58
CRUM           A 0468 10:61        64
CTR_OFF        A 0532 13:112      109
CYCLEFT        A 00cc  4:28        72   87   94   91
DDRA      EQU  A 0004  2:19        53
DDRB      EQU  A 0005  2:20        51   42   69
FAST           A 06c6 20:105       51
FAULT          A 0680 19:54        38
FAULTS    EQU  A 0019  2:21        64   93
FLAGREG1       A 00de  4:16        34   34   37   54   57   61   69   70  158  159  164  167  170  171  172  179  180  186  196
                                  263  273  276  300  301  305  315
FLAGREG2       A 00df  4:17        35  190  191  194  205  208  223  224  228  233  236  237  242  247
FLAGREG3       A 00e0  4:18        36   48   49   60   62   78   80   85   89   96   97  101  102  106  115  116  124  127  131
                                  137  139  147  148  264  272  279  280  284  287  288  320  339  340
GDLYON         A 04d9 12:54        48
GENCRC         A 0346  6:27
GENCRC1        A 034a  6:29        51
GFLAG1    EQU  A 0006  3:51        54   57   70  273
GOFFDLY   EQU  A 003c  3:16        63
GOFFREG        A 00a2  4:20        29   64   67  277
GONCTR         A 00ab  5:29        40   51   55  274
GONDLT    EQU  A 0004  3:17        50
GONFLAG   EQU  A 0005  3:47        48   49   60   62  272
GO_ON          A 0322  6:41        38
GTST1          A 0443 10:36        36
GTST2          A 0473 10:67        67
GWAIT1         A 0493 11:103      103  115
GWAIT2         A 04a2 11:112      112
G_CTR          A 04f1 12:67        60
G_DLYOFF       A 05ff 16:276      272  273
G_DLYON        A 05f7 16:272      263  264  267
G_ECON         A 04cb 12:47        36
G_OFF          A 04e4 12:60        47
HEAT           A 05ce 16:236      223
HEAT1     EQU  A 0001  3:26       199
HEAT2     EQU  A 0000  3:27       202
HEATMASK  EQU  A 0007  3:25       197
HEATOFF        A 05c6 16:231      224
HIGH           A 0485  9:34        28   35   38
HILOCNT1       A 00ec  5:30        74   29
HILOCNT2       A 00ed  5:31        75   24   31
HOLD1          A 0428  9:53        55
HOLD2          A 042b  9:56        56
HTOFFLAG       A 00b1 15:208      200  203
HZ60           A 00c9  4:25        22   74  100
ID10FPHB  EQU  A 0001  3:28       316
ID10FPHS  EQU  A 0000  3:29       317
ID20FPHB  EQU  A 0012  3:30       321
ID20FPHS  EQU  A 0008  3:31
IDDLYOFF  EQU  A 001c  3:19        99
IDDLYON   EQU  A 0004  3:18        81
IDOFFREG       A 00e3  4:21        30  100  110  112  285
ID_DLY         A 0604 16:279      276
ID_END         A 0648 17:331      327
ID_OFF         A 0646 17:329      322
ID_ON          A 0642 17:325      318
IND_DFT        A 0634 17:315      219
```

BEST AVAILABLE COPY

| | | | | | | | | | | | | | | | | | | | | | | |
|---|---|---|---|---|---|---|---|---|---|---|---|---|---|---|---|---|---|---|---|---|---|---|
| INITEND | | A | 03ba | 8:46 | 39 | | | | | | | | | | | | | | | | | |
| INITEST | | A | 00ef | 5:33 | 28 | | | | | | | | | | | | | | | | | |
| INPUTS | | A | 00c7 | 4:23 | 26 | 27 | 33 | 47 | 76 | 154 | 45 | 70 | | | | | | | | | | |
| IRQCNT | | A | 00da | 4:32 | 63 | 26 | 19 | 24 | | | | | | | | | | | | | | |
| IRQV | | A | 0658 | 18:17 | 17 | | | | | | | | | | | | | | | | | |
| ITS_ON | | A | 055a | 14:144 | 137 | | | | | | | | | | | | | | | | | |
| J1RAM | EQU | A | 00c0 | 2:26 | 35 | 42 | | | | | | | | | | | | | | | | |
| J1ROM | EQU | A | 0302 | 2:27 | 56 | | | | | | | | | | | | | | | | | |
| J1VCTRS | EQU | A | 07f8 | 2:28 | 94 | | | | | | | | | | | | | | | | | |
| LASTIN1 | | A | 00c2 | 4:18 | 17 | 64 | 82 | | | | | | | | | | | | | | | |
| LASTIN2 | | A | 00c3 | 4:19 | 18 | 76 | 87 | | | | | | | | | | | | | | | |
| LDMVSAME | | A | 06b8 | 19:95 | 88 | | | | | | | | | | | | | | | | | |
| LED | EQU | A | 0007 | 4:63 | 265 | 266 | 269 | | | | | | | | | | | | | | | |
| LEDOFF | | A | 05f5 | 16:269 | 265 | | | | | | | | | | | | | | | | | |
| LOOP | | A | 0668 | 18:29 | 30 | | | | | | | | | | | | | | | | | |
| LOOP1 | | A | 0665 | 18:27 | 32 | | | | | | | | | | | | | | | | | |
| LOW | | A | 03f8 | 9:28 | 29 | 32 | | | | | | | | | | | | | | | | |
| MAXCLOCK | EQU | A | 0090 | 2:20 | 51 | | | | | | | | | | | | | | | | | |
| MEMCHK | | A | 00ee | 5:32 | 27 | 30 | 31 | | | | | | | | | | | | | | | |
| MFGMODE | EQU | A | 0002 | 3:58 | 18 | | | | | | | | | | | | | | | | | |
| MFGTST | | A | 0431 | 10:23 | 18 | | | | | | | | | | | | | | | | | |
| MFGTST1 | | A | 0435 | 10:28 | 30 | 32 | | | | | | | | | | | | | | | | |
| MINCLOCK | EQU | A | 0010 | 2:19 | 49 | | | | | | | | | | | | | | | | | |
| MV | | A | 0562 | 14:154 | 85 | 123 | 124 | 132 | 135 | 142 | 145 | | | | | | | | | | | |
| MVBLYOFF | | A | 058b | 15:177 | 170 | | | | | | | | | | | | | | | | | |
| MVBLYON | | A | 0573 | 14:164 | 158 | | | | | | | | | | | | | | | | | |
| MVBOFFDLY | EQU | A | 00b4 | 3:23 | 173 | | | | | | | | | | | | | | | | | |
| MVBOFFREG | | A | 00e4 | 4:22 | 33 | 174 | 177 | 306 | | | | | | | | | | | | | | |
| MVBONDLY | EQU | A | 001e | 3:22 | 160 | | | | | | | | | | | | | | | | | |
| MVBONFLAG | EQU | A | 0000 | 3:52 | 263 | | | | | | | | | | | | | | | | | |
| MVBONREG | | A | 00e1 | 4:19 | 32 | 161 | 165 | 302 | | | | | | | | | | | | | | |
| MV_BLYOF | | A | 062d | 17:305 | 300 | 301 | | | | | | | | | | | | | | | | |
| MV_BLYON | | A | 0625 | 17:300 | 287 | 291 | 296 | | | | | | | | | | | | | | | |
| MV_OFF | | A | 057e | 14:170 | 154 | | | | | | | | | | | | | | | | | |
| NBRCNT | | A | 00e4 | 4:20 | 65 | 73 | 94 | | | | | | | | | | | | | | | |
| NBRVAR1 | | A | 0000 | 19:73 | 65 | | | | | | | | | | | | | | | | | |
| NBRVTR2 | | A | 06ec | 19:87 | 77 | | | | | | | | | | | | | | | | | |
| NBRWAME | | A | 00c5 | 4:21 | 67 | 79 | 97 | | | | | | | | | | | | | | | |
| NEXT | | A | 033c | 6:21 | 25 | | | | | | | | | | | | | | | | | |
| NOBFTDLY | EQU | A | 0003 | 3:59 | 109 | | | | | | | | | | | | | | | | | |
| NOISECNT | | A | 00dd | 4:35 | 62 | 48 | 54 | 58 | | | | | | | | | | | | | | |
| NORMOP | | A | 068c | 19:64 | 41 | | | | | | | | | | | | | | | | | |
| NUMCHK | | A | 00c6 | 4:22 | 26 | 33 | 71 | 39 | 50 | 51 | 59 | 72 | 90 | | | | | | | | | |
| NUMCHK2 | | A | 00dc | 4:34 | 70 | 73 | 83 | | | | | | | | | | | | | | | |
| OBCNTS | | A | 00e7 | 5:25 | 23 | 290 | 295 | 344 | | | | | | | | | | | | | | |
| ONE | EQU | A | 0001 | 2:16 | | | | | | | | | | | | | | | | | | |
| ONFLAG | EQU | A | 0004 | 3:46 | 137 | 139 | 147 | 288 | 340 | | | | | | | | | | | | | |
| ONTINCTR | | A | 00ea | 5:28 | 38 | 141 | 144 | 298 | 341 | | | | | | | | | | | | | |
| ONTIME | EQU | A | 0078 | 3:20 | 140 | | | | | | | | | | | | | | | | | |
| OUTBUF | | A | 05b3 | 15:219 | 192 | 206 | | | | | | | | | | | | | | | | |
| OUTPUT | | A | 0593 | 15:186 | 162 | 164 | 166 | 168 | 175 | 178 | | | | | | | | | | | | |
| OUTPUTS | | A | 00c8 | 4:24 | 28 | 54 | 35 | 38 | 226 | 231 | 240 | 245 | 250 | 251 | 255 | 265 | 266 | 269 | 325 | 329 | 17 | |
| PILOTOFT | EQU | A | 0001 | 3:57 | 123 | | | | | | | | | | | | | | | | | |
| PILOT_DL | | A | 0611 | 17:287 | 284 | | | | | | | | | | | | | | | | | |
| PILOT_ON | | A | 0623 | 17:298 | 288 | | | | | | | | | | | | | | | | | |
| PNREV | | A | 06de | 20:16 | 43 | 52 | 61 | 63 | | | | | | | | | | | | | | |
| PORTA | EQU | A | 0000 | 2:17 | 41 | 55 | 18 | 35 | 70 | 109 | 123 | 41 | 18 | | | | | | | | | |
| PORTB | EQU | A | 0001 | 2:18 | 36 | 40 | 67 | 68 | 102 | 103 | 106 | 109 | 110 | 112 | 113 | 35 | 38 | | | | | |
| PULSES | | A | 00cb | 4:27 | 24 | 54 | 80 | 99 | 101 | 104 | | | | | | | | | | | | |
| RAM | | A | 030f | 5:29 | 35 | | | | | | | | | | | | | | | | | |
| RAMCHK1 | | A | 0326 | 6:44 | 51 | | | | | | | | | | | | | | | | | |
| RAMCHK2 | | A | 032e | 6:50 | 46 | | | | | | | | | | | | | | | | | |
| RAMCHK4 | | A | 0324 | 6:42 | 58 | | | | | | | | | | | | | | | | | |
| RAMCHKEN | | A | 0339 | 6:60 | 48 | 55 | | | | | | | | | | | | | | | | |
| RAMTST | EQU | A | 00e6 | 3:32 | 37 | | | | | | | | | | | | | | | | | |
| RESET1 | | A | 06b0 | 19:90 | 71 | 74 | | | | | | | | | | | | | | | | |
| RESET2 | | A | 06b4 | 19:93 | 85 | | | | | | | | | | | | | | | | | |
| RESETV | | A | 0302 | 5:21 | 18 | 19 | | | | | | | | | | | | | | | | |
| RET | | A | 06c8 | 20:107 | 22 | 59 | 102 | | | | | | | | | | | | | | | |
| RMIMAGE | | A | 06d4 | 20:21 | 21 | | | | | | | | | | | | | | | | | |
| RMIMAGE1 | | A | 06dd | 20:25 | 23 | | | | | | | | | | | | | | | | | |
| ROMEND | EQU | A | 06ff | 2:29 | 85 | | | | | | | | | | | | | | | | | |
| RROMBYTE | | A | 00cd | 4:29 | 22 | 29 | 49 | 22 | 24 | | | | | | | | | | | | | |
| RTCNIBIT | | A | 00c1 | 4:17 | 57 | 31 | 37 | 43 | | | | | | | | | | | | | | |
| RTCLOCK | | A | 00c0 | 4:16 | 25 | 45 | 48 | 53 | 25 | | | | | | | | | | | | | |
| R_OFF | | A | 04c4 | 12:37 | 33 | | | | | | | | | | | | | | | | | |
| SEC60 | | A | 00ca | 4:26 | 20 | 18 | 19 | 21 | 22 | 219 | 221 | 17 | 50 | 105 | 22 | | | | | | | |
| SECONDS | | A | 0dbc | 19:99 | 68 | 80 | | | | | | | | | | | | | | | | |
| SERIAL | | A | 04ff | 11:101 | 45 | 56 | 65 | | | | | | | | | | | | | | | |
| SHORT_W | | A | 0527 | 13:105 | 97 | | | | | | | | | | | | | | | | | |
| SIX | EQU | A | 0006 | 2:17 | 42 | | | | | | | | | | | | | | | | | |
| SIXTY | EQU | A | 003b | 2:18 | 21 | | | | | | | | | | | | | | | | | |
| START | | A | 04ab | 11:18 | 58 | 331 | | | | | | | | | | | | | | | | |
| STARTX | | A | 04ef | 12:21 | 21 | 22 | | | | | | | | | | | | | | | | |

BEST AVAILABLE COPY

| | | | | | | | | | | | | | | |
|---|---|---|---|---|---|---|---|---|---|---|---|---|---|---|
| STRTIMER | EQU | A 0005 | 3:45 | 127 | 131 | 148 | 287 | 339 | | | | | | |
| STRTOVR | | A 046b | 19:61 | 57 | | | | | | | | | | |
| ST_TIMER | | A 00e9 | 5:27 | 39 | 92 | 130 | 134 | 293 | 342 | | | | | |
| SWICTR | | A 00a6 | 5:24 | 37 | 58 | 253 | 308 | | | | | | | |
| SWINT | | A 0632 | 17:308 | 305 | | | | | | | | | | |
| TCR | EQU | A 0009 | 2:24 | 24 | 40 | | | | | | | | | |
| TCSR | EQU | A 0008 | 2:22 | 49 | 20 | 26 | 29 | 30 | 35 | 36 | 34 | 79 | 21 | |
| TCSRMASK | | A 00ab | 4:33 | 47 | 78 | | | | | | | | | |
| TEST | | A 00e5 | 5:23 | 60 | 61 | 62 | 55 | 60 | | | | | | |
| TIMERS | | A 05a8 | 16:263 | 229 | 234 | 243 | 248 | 254 | 255 | | | | | |
| TIMERV | | A 06c9 | 20:17 | 16 | | | | | | | | | | |
| TRANS | | A 03f0 | 9:22 | 22 | | | | | | | | | | |
| TSTYES | | A 0441 | 10:35 | | | | | | | | | | | |
| VODLYOFF | | A 060c | 17:284 | 279 | 280 | | | | | | | | | |
| WAITIME | EQU | A 003c | 3:21 | 129 | | | | | | | | | | |
| WAIT_ON | | A 054b | 14:134 | 127 | | | | | | | | | | |
| WDOG | EQU | A 07f0 | 2:25 | 23 | 35 | 44 | 48 | 25 | | | | | | |
| WOFFLAG1 | EQU | A 0001 | 3:43 | 85 | 89 | 97 | 115 | 124 | 280 | | | | | |
| WOFFLAG2 | EQU | A 0002 | 3:44 | 101 | 116 | 284 | | | | | | | | |
| WONCTR | | A 00a8 | 5:26 | 31 | 82 | 86 | 105 | 282 | | | | | | |
| WONFLAG | EQU | A 0000 | 3:42 | 78 | 80 | 96 | 102 | 106 | 264 | 279 | | | | |
| W_DLYOFF | | A 052d | 13:109 | 96 | | | | | | | | | | |
| W_DLYON | | A 0507 | 13:85 | 78 | | | | | | | | | | |
| W_END | | A 053a | 13:123 | 83 | 87 | 93 | 103 | 107 | 113 | | | | | |
| W_SWDOFT | | A 0679 | 13:76 | 52 | 54 | 56 | 58 | 65 | 68 | | | | | |
| W_OFF | | A 0517 | 13:96 | 76 | | | | | | | | | | |
| XFER | | A 044e | 10:43 | 54 | | | | | | | | | | |

We claim:

1. Apparatus for controlling the energization of a main blower fan motor and an induced draft fan motor based on low voltage AC input signals comprising transformer means for providing a selected low voltage AC power supply from a line voltage AC power source having a selected frequency, means for providing a 5 volt DC power supply.

microprocessor means having input ports including an interrupt IRQ port and output ports and having a real time clock, the microprocessor means powered by the 5 volt DC power supply, low voltage input signal lines connected to the input ports and adapted to provide the low voltage AC input signals to the input ports, relays having contacts relatively movable into and out of engagement with one another is response to selected low voltage AC input signals to the input ports of the microprocessor means, the contacts adapted to energize high power lines coupled to the main blower fan motor and the induced draft fan motor, the low voltage AC power supply of the transformer means having an AC voltage common connected to the IRQ port, means to detect the falling edge of the AC voltage common wave at the IRQ port and, after a delay of a quarter of an AC wave length, to read the signals at the input ports, and, in response to the signals at the input ports, means to energize the relay contacts from an output signal at the microprocessor means based on the real time clock so that the output signal is asynchronous relative to the AC power line frequency.

2. Apparatus according to claim 1 in which the low voltage AC input signals are 24 volt signals and are each coupled to the input ports of the microprocessor means through a current limiting resistor and selected low voltage AC input signals are connected to the AC voltage common through a pull down resistor.

3. Apparatus according to claim 2 in which the current limiting resistor is 100K ohms.

4. Apparatus according to claim 2 in which the output signal include a high speed signal on a high speed signal line and a low speed signal on a low speed signal line for the main blower fan motor and an induced draft fan signal on an induced draft fan signal line.

5. Apparatus according to claim 4 further including a zener diode serially connected to the input ports to prevent conduction of current to the input ports below a selected level.

6. Apparatus according to claim 2 further including relay driver means interconnected between the output ports and the relays.

7. Apparatus according to claim 2 in which one of the low voltage AC input signals is for a main valve input, the main valve input being connected to the AC power source through a pull up resistor.

8. Apparatus according to claim 1 including means to periodically calibrate the reading of the input ports to assure that the reading is synchronous with the AC power source.

9. Apparatus according to claim 1 in which the low voltage AC input signals are read at the peak of the AC input signal.

10. Apparatus according to claim 9 in which the input ports are read a selected number of times before the microprocessor means generates an output.

11. Apparatus according to claim 1 in which selected time delays determined by the real time clock are provided in the microprocessor means before an output is generated to energize a selected relay.

12. Apparatus according to claim 1 in which the main blower fan motor has a cool speed winding and a heat speed winding and separate relays for energizing each speed winding, the heat speed winding having a selected time delay on and a selected time delay off.

13. Apparatus according to claim 12 in which the cool speed winding is energized instantly upon generating a low voltage AC input signal and has a selected time delay off.

14. Apparatus according to claim 13 in which a low voltage AC input signal for the cool speed winding overrides a low voltage AC input signal for the heat speed winding.

15. Apparatus according to claim 13 in which the induced draft fan motor has a selected time delay off.

16. The method of controlling a system having a main blower fan motor with heat and cool speed windings and an induced draft fan motor responsive to input signals from a thermostat calling respectively for energization of the heat and cool speed windings and energization of the induced draft fan motor, the system having a microprocessor means for receiving the input signals and for generating output signals, the microprocessor means having an IRQ interrupt port and a real time clock, the system having transformer means for transforming line AC voltage to 24 volt AC power for the input signals including a transformer common, rectified 24 VAC power to energize relays and 5 volt DC power to power the microprocessor means, and respective separate relays for energizing the heat and cool speed windings and the induced draft fan motor in response to the output signals from the microprocessor means, the method comprising the steps of:

coupling the transformer common to the IRQ interrupt port, executing a sub-routine on each falling edge of an AC voltage common wave on the transformer common, the sub-routine comprising the step of waiting one quarter of a wave of the AC voltage common wave and then reading the input signals to the microprocessor means so that the input signals are read at the peak of the AC wave of the input signals synchronously with the AC voltage, generating an output signal by the microprocessor means in response to respective input signals and the read time clock to coupled the 24 volt DC power to a selected relay asynchronously to the line AC voltage.

17. The method of controlling a system according to claim 16 including the step of calibrating the reading of input signals each time the system is energized by finding an edge of the AC voltage common wave form, counting the real time clock cycles in one complete AC line cycle and deriving one quarter of a wave time period.

18. The method of controlling a system according to claim 17 in which the step of calibrating is performed on a periodic basis every few seconds.

19. The method of controlling a system according to claim 16 including the step of calibrating the reading of input signals on a periodic basis every few seconds that the system is energized by finding an edge of the AC voltage common wave form, counting the real time clock cycles in one complete AC line cycle and deriving one quarter of a wave time period.

20. Apparatus for controlling the energization of a load based on low voltage AC input signals comprising transformer means for providing a selected low voltage AC power supply from a line voltage AC power source having a selected frequency, means for providing a 5 volt DC power supply.

microprocessor means having input ports including an interrupt IRQ port and output ports and having a real time clock, the microprocessor means powered by the 5 volt DC power supply, low voltage input signal lines connected to the input ports and adapted to provide the low voltage AC input signals to the input ports, relay means having contacts relatively movable into and out of engagement with one another in response to selected low voltage AC input signals to the input ports of the microprocessor means, the contacts adapted to energize high power lines coupled to the load, the low voltage AC power supply of the transformer means having an AC voltage common connected to the IRQ port, means to detect the falling edge of the AC voltage common wave at the IRQ port and, after a delay of a quarter of an AC wave length, to read the signals at the input ports, the low voltage AC input signals being coupled to the input ports of the microprocessor means through current limiting resistors and selected input signals being connected to the AC voltage common through a pull down resistor, and, based on the input signals at the input ports, means to energize the relay contacts from an output signal of the microprocessor means.

21. Apparatus according to claim 20 in which the low voltage AC input signals are 24 volt signals and the current limiting resistor is 100K ohms.

22. Apparatus according to claim 20 in which one of the input signals is for a main valve input, the main valve input being connected to the AC power supply through pull up resistor.

* * * * *